US009964907B2

(12) United States Patent
Uehara et al.

(10) Patent No.: US 9,964,907 B2
(45) Date of Patent: May 8, 2018

(54) IMAGE FORMING APPARATUS AND IMAGE FORMING SYSTEM

(71) Applicant: CANON KABUSHIKI KAISHA, Tokyo (JP)

(72) Inventors: Masahiro Uehara, Susono (JP); Hideyuki Matsubara, Mishima (JP); Tadashi Okanishi, Mishima (JP); Eijiro Ohashi, Boise, ID (US); Masayoshi Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/039,351

(22) PCT Filed: Nov. 18, 2014

(86) PCT No.: PCT/JP2014/005774

§ 371 (c)(1),
(2) Date: May 25, 2016

(87) PCT Pub. No.: WO2015/079651

PCT Pub. Date: Jun. 4, 2015

(65) Prior Publication Data

US 2017/0023900 A1 Jan. 26, 2017

(30) Foreign Application Priority Data

Nov. 29, 2013 (JP) ..... 2013-248444
May 7, 2014 (JP) ..... 2014-095837

(51) Int. Cl.
*G03G 15/00* (2006.01)

(52) U.S. Cl.
CPC ..... *G03G 15/5062* (2013.01); *G03G 15/55* (2013.01); *G03G 15/6502* (2013.01); *G03G 15/6564* (2013.01)

(58) Field of Classification Search
CPC ..... G03G 15/5062
(Continued)

(56) References Cited

U.S. PATENT DOCUMENTS 4,908,673 A * 3/1990 Muramatsu ..... G03G 15/234 271/171
2003/0133002 A1* 7/2003 Morita ..... G06K 9/3283 347/139

(Continued)

FOREIGN PATENT DOCUMENTS

JP 10-194529 A 7/1998
JP 2001-206583 A 7/2001
JP 2009-249093 A 10/2009

*Primary Examiner* — Anthony Nguyen
(74) *Attorney, Agent, or Firm* — Canon U.S.A., Inc. IP Division

(57) ABSTRACT

An image forming apparatus includes a feeding unit, a regulation member, a detection unit, and a control unit. The feeding unit feeds a recording material from a storage unit to a conveying path. In the storage unit, the regulation member controls a trailing edge of the recording material in a feeding direction. The detection unit detects time until the recording material reaches a predetermined position along the conveying path after the feeding unit begins to feed the recording material. The control unit determines a state of the regulation member based on the detected time. Where the time detected by the detection unit is a value between a first threshold and a second threshold, which is larger than the first threshold, the control unit determines that the regulation member is shifting from a position corresponding to a size of the recording material in the feeding direction.

27 Claims, 17 Drawing Sheets

(58) Field of Classification Search
USPC ..... 399/394
See application file for complete search history.

(56) References Cited

U.S. PATENT DOCUMENTS

2008/0246977 A1* 10/2008 Fujii ..... B41J 11/003 358/1.2
2009/0121411 A1* 5/2009 Kosugi ..... B65H 3/128 271/97
2009/0166965 A1* 7/2009 Fukasawa ..... B65H 3/0684 271/265.03
2009/0236795 A1* 9/2009 Suzuki ..... B65H 1/14 271/94
2013/0195531 A1* 8/2013 Nakamura ..... G03G 15/6502 399/388
2013/0250328 A1* 9/2013 Ohtsuka ..... H04N 1/0066 358/1.13

* cited by examiner

| NUMBER OF IMAGES FORMED | 0 TO 5000 | 5001 TO 10000 | 10000 TO 15000 | 15000 TO 20000 | 20000 TO 25000 |
|---|---|---|---|---|---|
| CORRECTION TIME (ms) | ALPHA | 2 ALPHA | 3 ALPHA | 4 ALPHA | 5 ALPHA |

IMAGE FORMING APPARATUS AND IMAGE FORMING SYSTEM

TECHNICAL FIELD

The present invention relates to an image forming apparatus including a storage unit that stores a recording material, and, more particularly, to an image forming apparatus having a function of detecting or determining the state of the recording material in the storage unit.

BACKGROUND ART

In an image forming apparatus, a recording material feeding unit (hereinafter referred to as a paper-feed cassette), which is a storage unit that stores a recording material, or the like feeds recording sheets. The image forming apparatus has a function of detecting conveying time, which is time until the recording material reaches a position along a conveying path after the paper-feed cassette begins to feed the recording material. After detecting the conveying time, the image forming apparatus controls a speed at which the recording material is conveyed in order to adjust a timing at which an image is formed, and determines the length of the recording material in a feeding direction and the conveying state of the recording material. For example, in PTL 1, detection of the conveying time and control of the speed at which the recording material is conveyed are described. In PTL 2, detection of the length of the recording material based on the conveying time is described.

CITATION LIST

Patent Literature

PTL 1: Japanese Patent Laid-Open No. 2001-206583
PTL 2: Japanese Patent Laid-Open No. 10-194529

SUMMARY OF INVENTION

Technical Problem

In general, regulation plates that control the position of the recording material are provided inside the storage unit for the recording material. The regulation plates include a trailing edge regulation plate that controls a trailing edge of the recording material in the feeding direction and side edge regulation plates that control edges of the recording material in a direction perpendicular to the feeding direction. These regulation plates can move in accordance with the size (for example, an A4, B4, or A5 paper size or the like) of the recording material. A user moves the regulation plates in accordance with the size of the recording material and stores the recording material.

It is possible that the trailing edge regulation plate in the storage unit shifts from a normal position corresponding to the size of the recording material. For example, when A4 size sheets are stored, the trailing edge regulation plate might be set at a farther position that does not correspond to the size. If the trailing edge regulation plate is not correctly set in the storage unit, the conveying time might increase. If the conveying time increases, the recording material does not reach the position along the conveying path at a predetermined timing, and accordingly it is determined that a conveying failure has occurred. As a result, formation of an image stops. It is desired to decrease the possibility of a conveying failure when the trailing edge regulation plate is incorrectly set in the storage unit, in order to improve productivity and usability.

If a conveying failure of the recording material occurs in the feeding unit of the recording material, a feeding operation performed by the feeding unit stops. The user needs to remove a piece of the recording material that has caused the conveying failure. The feeding unit desirably suppresses occurrence of such a conveying failure of the recording material as much as possible. Immediately after the storage unit storing the recording material, that is, for example, a cassette or a tray storing the recording material, is removed and attached (opened and closed), a conveying failure of the recording material is likely to occur. Since the user might not have correctly set the recording material in the cassette or the tray, a conveying failure is likely to occur immediately after the cassette or the tray is removed and attached.

Solution to Problem

An image forming apparatus according to an aspect of the present invention includes a storage unit configured to store a recording material, a feeding unit configured to feed the recording material to a conveying path from the storage unit, a regulation member configured to control a downstream edge of the recording material in a feeding direction in the storage unit, a detection unit configured to detect time until the recording material reaches a position along the conveying path after the feeding unit begins to feed the recording material, and a control unit configured to determine a state of the regulation member on the basis of the time detected by the detection unit.

An image forming apparatus according to another aspect of the present invention includes a storage unit configured to store a recording material, a feeding unit configured to feed the recording material to a conveying path from the storage unit, regulation member configured to control a downstream edge of the recording material in a feeding direction in the storage unit, a detection unit configured to detect opening and closing of the storage unit, and a control unit configured to, after the detection unit detects opening and closing of the storage unit, measure reaching time, which is time until the recording material reaches a position along the conveying path after the feeding unit begins to feed the recording material, and determine a state of the regulation member on the basis of measured first reaching time and second reaching time, which is measured before the detection unit detects opening and closing of the storage unit.

An image forming system according to another aspect of the present invention is an image forming system including an image forming apparatus and an input/output apparatus connected to the image forming apparatus. The image forming system includes a storage unit configured to store a recording material, a feeding unit configured to feed the recording material to a conveying path from the storage unit, a regulation member configured to control a downstream edge of the recording material in a feeding direction in the storage unit, a detection unit configured to detect time until the recording material reaches a position along the conveying path after the feeding unit begins to feed the recording material, and a control unit configured to output information indicating a state of the regulation member to the input/output apparatus on the basis of the time detected by the detection unit.

An image forming system according to another aspect of the present invention is an image forming system including an image forming apparatus and an input/output apparatus connected to the image forming apparatus. The image forming system includes a storage unit configured to store a recording material, a feeding unit configured to feed the recording material to a conveying path from the storage unit, a regulation member configured to control a downstream edge of the recording material in a feeding direction in the storage unit, a detection unit configured to detect time until the recording material reaches a position along the conveying path after the feeding unit begins to feed the recording material, and a control unit configured to, after the detection unit detects opening and closing of the storage unit, measure reaching time, which is time until the recording material reaches the position along the conveying path after the feeding unit begin to feed the recording material, and output information indicating a state of the regulation member to the input/output apparatus on the basis of measured first reaching time and second reaching time, which is measured before the detection unit detects opening and closing of the storage unit.

Advantageous Effects of Invention

As described above, according to the present invention, if a regulation plate is incorrectly set in the storage unit for the recording material, the possibility of a conveying failure can be reduced, thereby improving productivity and usability.

DESCRIPTION OF EMBODIMENTS

Figure 1A:
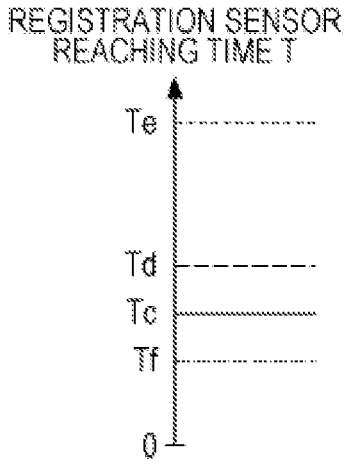
FIG. 1A is a diagram illustrating the reaching time of a recording material.

Next, specific configurations of the present invention for solving the above-described problem will be described hereinafter on the basis of embodiments. The following embodiments are examples and not intended to limit the technical scope of the present invention.

First Embodiment

First, the overall configuration of an image forming apparatus according to a first embodiment will be described with reference to FIG. 2.

A controller 110 controls an operation for forming an image performed by an image forming apparatus 200. The controller 110 includes a central processing unit (CPU) 100, which is an arithmetic unit. The operation for forming an image that will be described hereinafter is controlled on the basis of a control program stored in a memory (a read-only memory (ROM), an electrically erasable programmable read-only memory (EEPROM), or the like) 101 provided for the controller 110.

A paper-feed unit 230 including a storage section 218 (hereinafter referred to as a "paper-feed cassette 218") for storing a recording material P is provided. A paper-feed roller 216, which is a feeding unit, feeds the recording material P stored in the paper-feed cassette 218 piece by piece at timings in accordance with an instruction from the CPU 100 of the controller 110. The fed recording material P is then conveyed toward a photosensitive drum 206 by conveying rollers 215 and 214, which are conveying units. The paper-feed roller 216 and the conveying rollers 214 and 215 are driven by a conveying motor 233 and a solenoid 234, which will be described later. A trailing edge regulation plate 219, which is a regulation member, that controls the recording material P in accordance with the size of the recording material P is provided for the paper-feed cassette 218.

A sensor 213, which is a detection unit, provided along a conveying path 217 at a position detects the recording material P fed from the paper-feed cassette 218 and conveyed by the conveying rollers 215. The sensor 213 is a sensor for detecting the conveyed recording material P before a toner image formed on the photosensitive drum 206 is transferred to the recording material P. The CPU 100 measures time until the recording material P reaches the sensor 213 after the paper-feed roller 216 begins to feed the recording material P.

Figure 2:
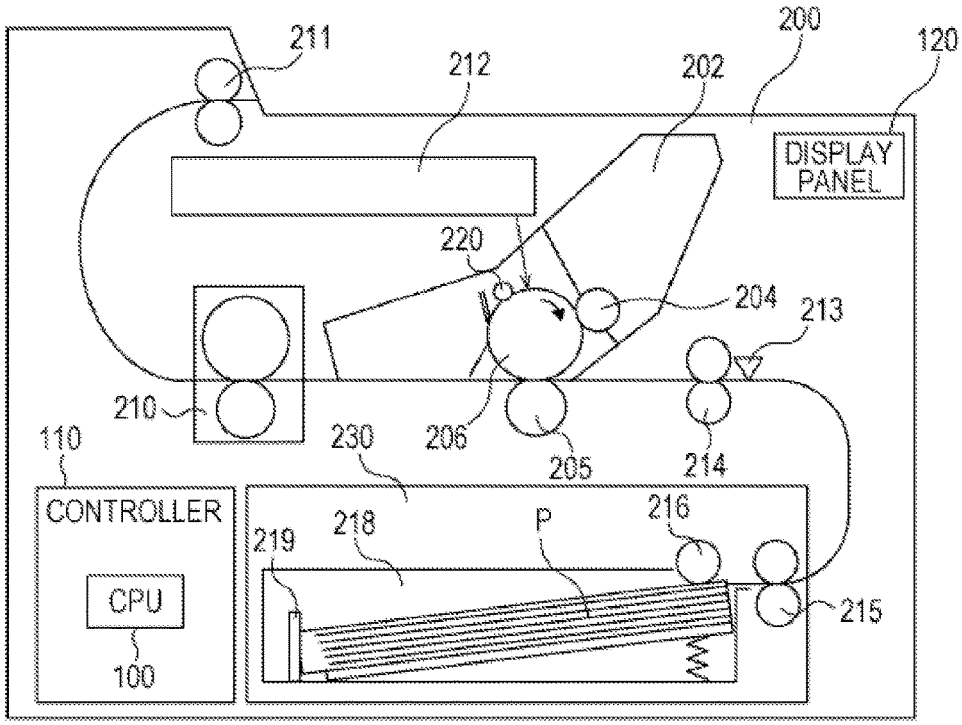
FIG. 2 is a diagram illustrating the configuration of an image forming apparatus.

The photosensitive drum 206 rotates in the direction of an arrow illustrated in FIG. 2. Charging voltage (also referred to as "charging bias") is applied to a charging roller 220 at a timing, and the charging roller 220 uniformly charges a surface of the photosensitive drum 206. Thereafter, a laser scanner unit 212 outputs laser light at a timing. The laser light output from the laser scanner unit 212 is radiated onto the photosensitive drum 206 to form an electrostatic latent image on the photosensitive drum 206. Developing voltage (also referred to as "developing bias") is applied to a developing roller 204. A toner container 202 is filled with toner for developing the electrostatic latent image formed on the photosensitive drum 206. The developing roller 204 to which the developing bias has been applied rotates to supply toner to the photosensitive drum 206, and the formed electrostatic latent image is visualized (developed) as a toner image.

A transfer roller 205 faces the photosensitive drum 206, and the photosensitive drum 206 and the transfer roller 205 together form a transfer nip. The conveyed recording material P is pinched by the transfer nip and further conveyed. At this time, transfer voltage (also referred to as "transfer bias") having a polarity opposite to that of toner is applied to the transfer roller 205 to transfer the toner image on the photosensitive drum 206 to the recording material P.

The recording material P to which the toner image has been transferred is further conveyed to a fixing unit 210. The fixing unit 210 heats and pressurizes the recording material P to fix the toner image onto the recording material P. The recording material P onto which the toner image has been fixed is discharged from the image forming apparatus 200 by conveying rollers 211.

Figure 4:
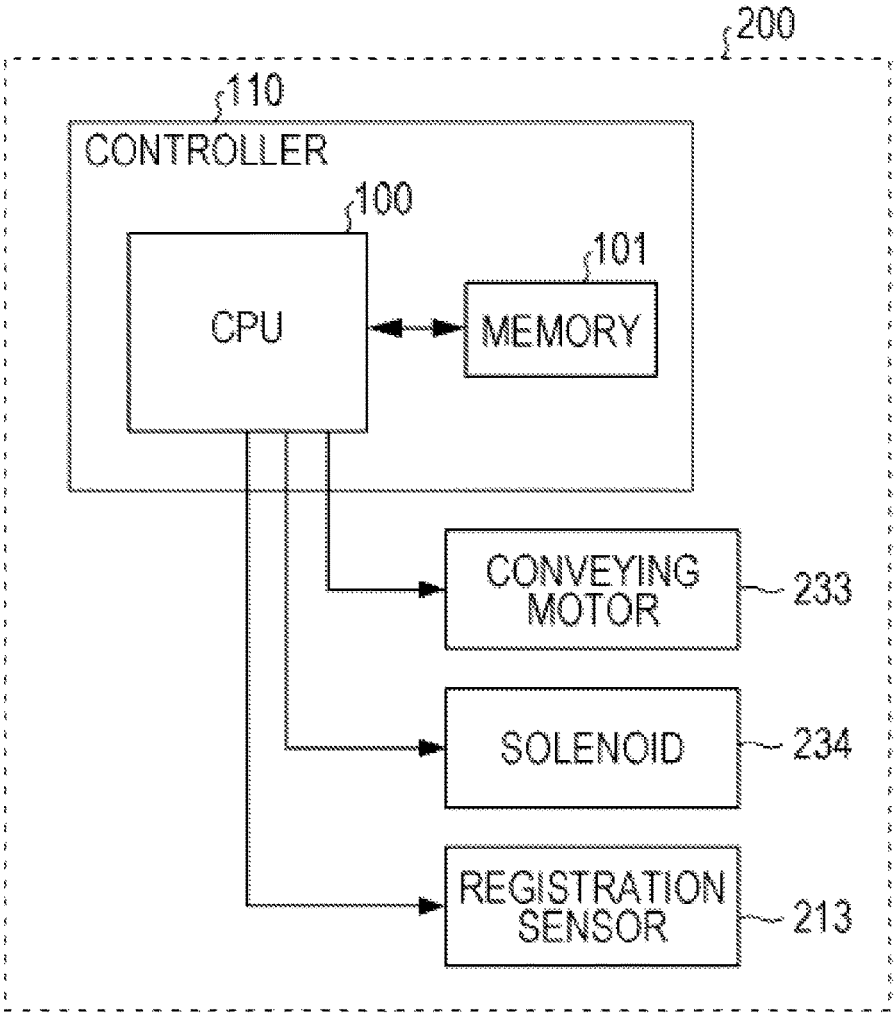
FIG. 4 is a block diagram illustrating an example of the configuration of a control unit in the present invention.

Next, an operation for feeding and conveying the recording material P will be described with reference to FIGS. 2 and 4. FIG. 4 is a control block diagram illustrating an example of a relationship between the controller 110 for controlling the operation for conveying the recording material P in the image forming apparatus 200 and other components.

First, the CPU 100 of the controller 110 outputs a driving signal to the conveying motor 233 to rotate the conveying rollers 215. Thereafter, in order to begin to feed the recording material P, the CPU 100 outputs a driving signal to the solenoid 234 to rotate the paper-feed roller 216 one revolution. A top one of a plurality of pieces of the recording material P stored in the paper-feed cassette 218 and pushed upward comes into contact with the paper-feed roller 216. Since the paper-feed roller 216 rotates one revolution in this state, the recording material P is fed piece by piece and conveyed to the conveying rollers 215. The recording material P is pinched by the conveying rollers 215 and conveyed to the sensor 213. When a leading edge of the recording material P reaches the sensor 213, the sensor 213 detects the recording material P and transmits a detection signal to the CPU 100. The CPU 100 measures reaching time T, which is time until the sensor 213 detects the recording material P after the paper-feed roller 216 begins to feed the recording material P.

An ideal value of the reaching time T is denoted by Tc. The ideal value Tc is a value predetermined on the basis of a distance along the conveying path 217 between the paper-feed roller 216 and the sensor 213 and a speed at which the recording material P is conveyed. The ideal value Tc in this embodiment is time until the recording material P reaches the sensor 213 without variation in feeding after the paper-feed roller 216 begins to feed the recording material P.

The timing at which each piece of the recording material P reaches the registration sensor 213 varies because, for example, the recording material P fed by the paper-feed roller 216 might slip on the paper-feed roller 216 or the conveying rollers 215 and a plurality of pieces of the recording material P might be fed at the same time. For example, when a piece of the recording material P is fed and conveyed, a next piece of the recording material P might also be fed to some point, which means that a plurality of pieces of the recording material P are in the conveying path 217. If the next piece of the recording material P is conveyed in this state, a leading edge of the next piece of the recording material P reaches the registration sensor 213 earlier than indicated by the ideal value Tc. When a plurality of pieces of the recording material P are fed at the same time, a leading edge of a next piece of the recording material P is located between a leading edge regulation plate 240 (refer to FIG. 3) of the paper-feed cassette 218 and a nip of the conveying rollers 215, at which the conveying rollers 215 pinch the recording material P. If the recording material P slips on the paper-feed roller 216, the leading edge of the recording material P reaches the sensor 213 later than indicated by the ideal value Tc. How the recording material P slips on the paper-feed roller 216 varies depending on the wear state of the paper-feed roller 216 and the type of recording material P (plain paper, gloss paper, rough paper, heavy paper, thin paper, or the like). The conveying speed varies depending on differences in the roller diameters of the paper-feed roller 216 and the conveying rollers 215. Therefore, the reaching time T varies between Tf and Td illustrated in FIGS. 1A and 1B, which will be referred to hereinafter.

Next, changes in the time until the recording material P reaches the sensor 213 after the paper-feed roller 216 begins to feed the recording material P at a time when a plurality of pieces of the recording material P are fed will be described with reference to FIGS. 1A and 1B.

As illustrated in FIG. 1A, values Tf, Td, and Te are stored in a storage unit of the CPU 100 in advance as values for determining the registration sensor reaching time T (hereinafter referred to as the "reaching time T"). The reaching time T indicates time until the leading edge of the recording material P stored in the paper-feed cassette 218 reaches the registration sensor 213. Tf denotes a lower limit value of variation in the reaching time T, Td denotes an upper limit value of variation in the reaching time T, and Tc denotes the ideal value of the reaching time T. Appropriate values (a lower limit value and an upper limit value of variation) are set as Tf and Td at least in accordance with the operation conditions of the image forming apparatus 200, the type of recording material P, the size of the recording material P, or the conveying speed of the recording material P.

Te is determined at least in accordance with the operation conditions of the image forming apparatus 200, the operation conditions of a conveying unit, the conveying speed of the recording material P, or the like so that an image can be formed even after the paper-feed roller 216 and the conveying rollers 215 are worn (deteriorate). Therefore, if the reaching time T falls short of Tf or exceeds Te, the CPU 100 determines that there is a conveying failure because it is difficult to perform an appropriate conveying operation or form an image, and stops the operation.

Figure 1B:
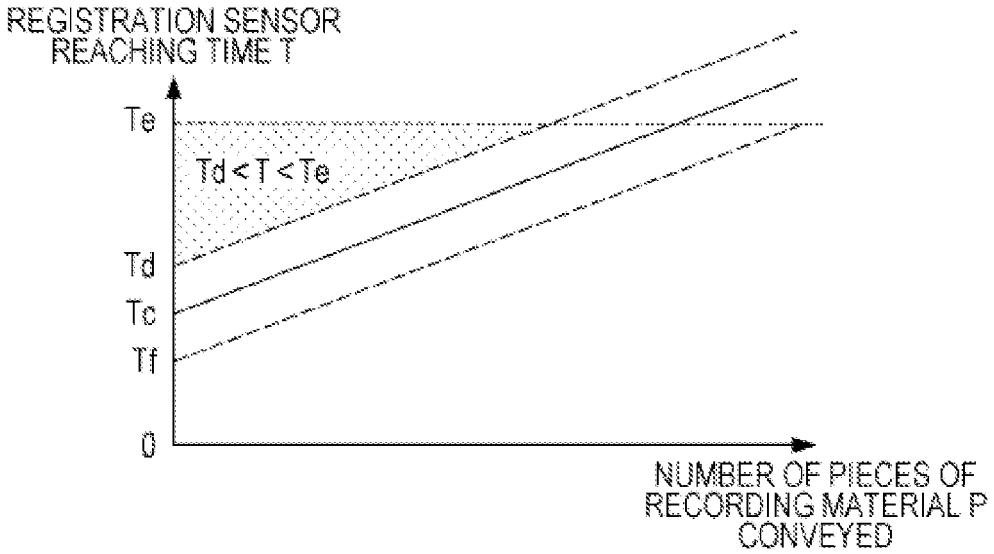
FIG. 1B is a diagram illustrating the reaching time of the recording material.

As illustrated in FIG. 1B, Tc, Td, and Tf change in accordance with the number of pieces of the recording material P conveyed (the total number of pieces) and the recording material P. FIG. 1B illustrates an example of set thresholds for the reaching time T at a time when plain paper is conveyed. The storage unit of the CPU 100 stores thresholds corresponding to the number of pieces of the recording material P conveyed (the total number of pieces) in advance as a table. The table of the thresholds may be provided for each type of recording material P, each size of the recording material P, or each conveying speed. The values of Tc, Td, and Tf are stored in the storage unit as thresholds set in consideration of the wear states of the paper-feed roller 216 and the conveying rollers 215 in accordance with the number of pieces of the recording material P (the total number of pieces), which corresponds to the use state of the image forming apparatus 200. As a unit for detecting the type of recording material P or the size of the recording material P, for example, user setting or a detection unit such as a medium sensor may be used. In the user setting, the type of recording material P or the size of the recording material P is specified using an operation button (not illustrated) provided in a display unit, which is a display panel 120 illustrated in FIG. 2 that also serves as an operation unit. Alternatively, the type of recording material P or the size of the recording material P can be set from a computer connected to the image forming apparatus 200. The medium sensor is, for example, a sensor that detects surface conditions, thickness, and the like by radiating light onto the recording material P, receiving the light that has been reflected from the recording material P and the light that has passed through the recording material P, and capturing an image of the received light or the intensity of the received light. Alternatively, the medium sensor may be a sensor that detects the weight of the recording material P by transmitting an ultrasonic wave to the recording material P and receiving the ultrasonic wave that has been reflected from the recording material P and the ultrasonic wave that has passed through the recording material P.

Figure 3A:
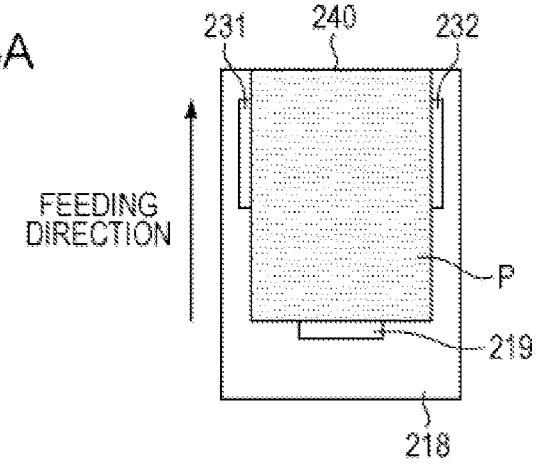
FIG. 3A is a diagram illustrating the state of the recording material in a paper-feed cassette according to a first embodiment.

Here, the thresholds Tf and Td are determined when the paper-feed cassette 218 stores the recording material P with regulation plates at their respective normal positions as illustrated in FIG. 3A. With the regulation plates at the normal positions, the leading edge of the recording material P substantially matches the leading edge regulation plate 240 of the paper-feed cassette 218 in a feeding direction. At the normal positions, side regulation plates 231 and 232 are at positions that control edges of the recording material P in a direction perpendicular to a feeding direction of the recording material P. The trailing edge regulation plate 219 controls a downstream edge (hereinafter also referred to as a "trailing edge") of the recording material P in the feeding direction of the recording material P. The trailing edge regulation plate 219 can move in accordance with the size of the recording material P stored in the paper-feed cassette 218.

Figure 3B:
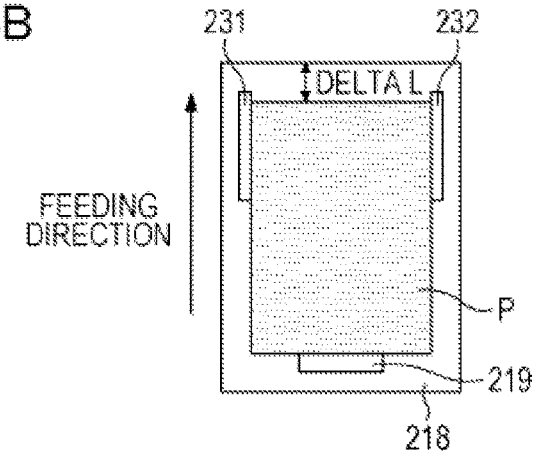
FIG. 3B is a diagram illustrating the state of the recording material in the paper-feed cassette according to the first embodiment.
Figure 3C:
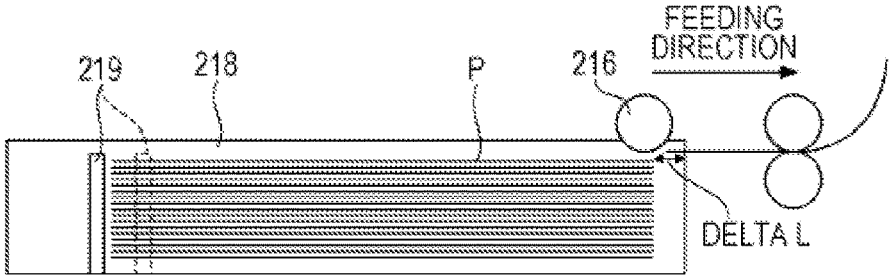
FIG. 3C is a diagram illustrating the state of the recording material in the paper-feed cassette according to the first embodiment.

As illustrated in FIG. 3B, if the recording material P is shifting from the normal position in the paper-feed cassette 218 in a direction opposite to the feeding direction, the trailing edge of the recording material P may match the trailing edge regulation plate 219. FIG. 3C is a diagram illustrating the state illustrated in FIG. 3B viewed from the direction perpendicular to the feeding direction of the recording material P. If the recording material P is fed and conveyed in the state illustrated in FIGS. 3B and 3C, a conveying distance between the leading edge of the recording material P and the sensor 213 becomes longer by delta L, and the reaching time T also becomes longer. That is, since the trailing edge regulation plate 219 is shifting from the normal position (a position indicated by broken lines in FIG. 3C and also referred to as a "reference position") by delta L, the reaching time T becomes longer than when the trailing edge regulation plate 219 is located at the normal position by time corresponding to delta L. Depending on delta L, the reaching time T might exceed the upper limit value Td. If the reaching time T<Te, however, an image can be formed. Te is set in consideration of a maximum delay in the conveying of the recording material P. Since the recording material P is not set at the normal position in the paper-feed cassette 218, however, a paper-feed failure or a conveying failure is likely to occur. Thus, the possibility of a conveying failure increases depending on how a user uses the image forming apparatus 200, that is, the position of the trailing edge regulation plate 219 set by the user.

Therefore, in this embodiment, since, if Td< the reaching time T<Te, the recording material P might have been set at a position farther than the normal position, the CPU 100 determines that the trailing edge regulation plate 219 needs to be readjusted and outputs a message. In the following description, if the reaching time T is equal to or longer than Tf but shorter than or equal to Td, the conveying of the recording material P is regarded as normal.

Figure 5:
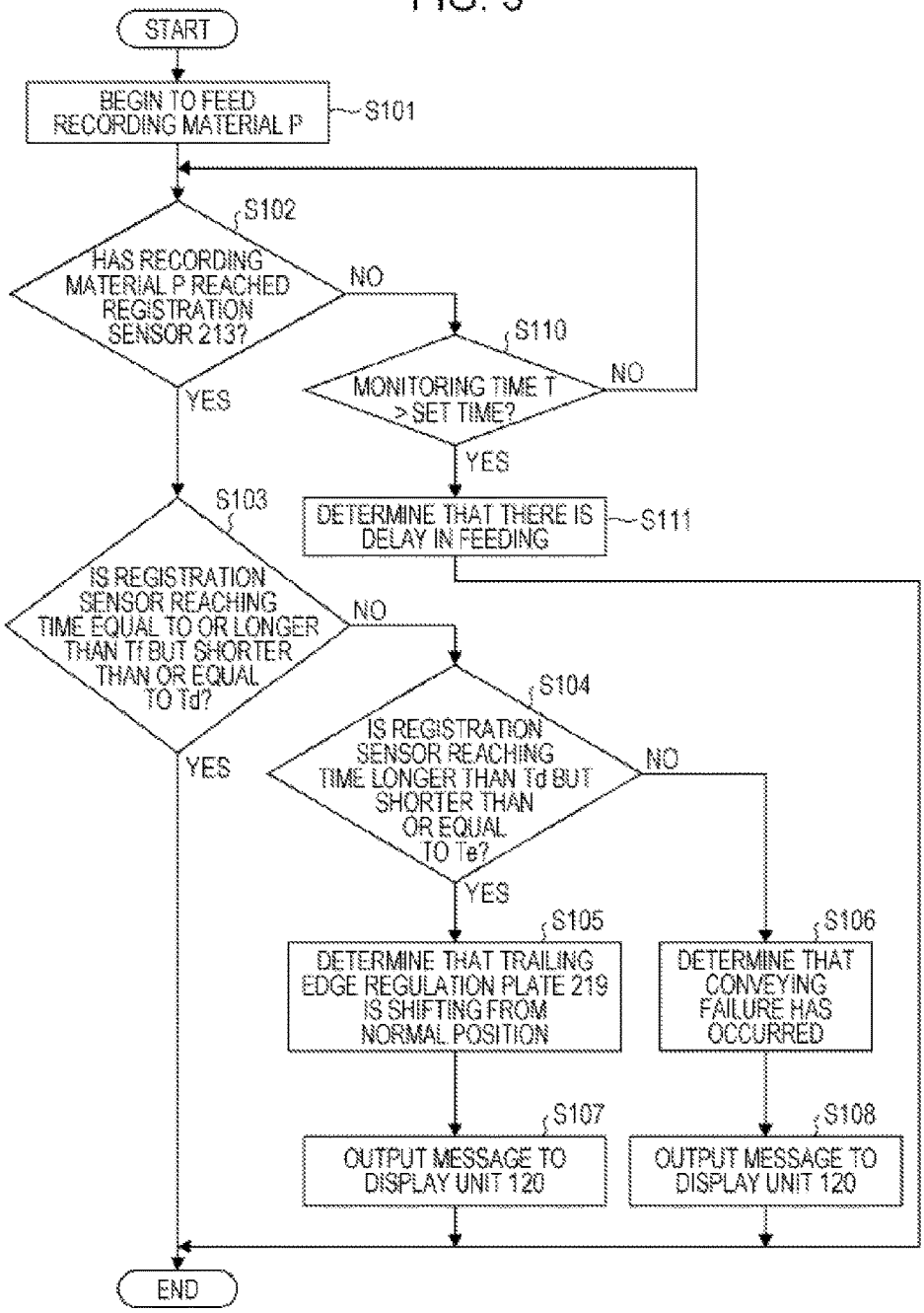
FIG. 5 is a flowchart according to the first embodiment.

FIG. 5 is a flowchart illustrating control performed by the CPU 100 according to this embodiment.

In this embodiment, the CPU 100 detects the type of recording material P and the size of the recording material P set by the user before the reaching time T is measured. Alternatively, a configuration for automatically detecting the type of recording material P using a medium sensor may be applied as described above. The CPU 100 monitors and detects outputs of the sensor (registration sensor 213) provided along the conveying path 217 such as the conveying speed of the recording material P and the number of pieces of the recording material P conveyed. The CPU 100 controls the conveying operation while monitoring the conveying state of the recording material P.

The CPU 100 begins to measure the reaching time T, which is the time until the recording material P reaches the registration sensor 213 after the CPU 100 issues an instruction to begin to feed the recording material P from the power line 118 (S101). The CPU 100 keeps measuring the reaching time T until the recording material P reaches the registration sensor 213 (until the recording material P is detected). The CPU 100 then determines whether the measured reaching time T is longer than set time (S110). The determination is made until the recording material P reaches the registration sensor 213 (S102). If it is determined in S110 that the recording material P has not reached the registration sensor 213 within the set time, it is determined that there is a delay in conveying of the recording material P, and the monitoring operation ends (S111). If it is determined that the recording material P has reached the registration sensor 213, the CPU 100 compares the measured reaching time T and the thresholds recorded in the memory 101 of the controller 110 in advance (S103). The thresholds are thresholds according to the number of pieces of the recording material P conveyed, the type of recording material P, and the size of the recording material P and refer to Tf, Td, and Te, which have been described as values for determining the reaching time T. If the reaching time T is equal to or longer than Tf but shorter than or equal to Td, the CPU 100 determines that the normal operation is being performed and ends the monitoring operation. On the other hand, if the reaching time T is not equal to or longer than Tf nor shorter than or equal to Td, the CPU 100 determines whether the reaching time T is longer than Td but shorter than or equal to Te (S104). If the reaching time T is longer than Td but shorter than or equal to Te, the conveying time of the recording material P is allowable, but the CPU 100 determines that the trailing edge regulation plate 219 in the paper-feed cassette 218 might be shifting from the normal position (S105) and ends the monitoring process. After a print operation is performed on the fed recording material P, the CPU 100 performs control for outputting, on the display panel 120, a message suggesting that the position of the trailing edge regulation plate 219 in the paper-feed cassette 218 be checked (S107). On the other hand, if the reaching time T<Tf or Te< the reaching time T, the CPU 100 determines that there is a conveying failure (S106) and performs control for outputting information, on the display panel 120, indicating that a conveying failure has occurred (S108). The CPU 100 then ends the monitoring operation.

The CPU 100 need not necessarily compare the measured reaching time T with the thresholds stored in the light source 101 for each piece of the conveying recording material P. For example, the CPU 100 may measure the reaching times T of a plurality of pieces of the sequentially conveyed recording material P and make a determination by comparing an average of the reaching times T with the thresholds.

In this embodiment, if the reaching time T is longer than Td but shorter than or equal to Te (YES in S104), the CPU 100 outputs a message suggesting that the position of the trailing edge regulation plate 219 in the paper-feed cassette 218 be checked.

Even if Te< the reaching time T, however, the above determination need not be made if the following condition is added. For example, if Te< the reaching time T and the reaching time T of a previous piece of the recording material P is within the range of Tf to Td, the CPU 100 may make the following determination.

For example, the CPU 100 may determine that although the conveying time of the recording material P is not allowable, the position of the trailing edge regulation plate 219 in the paper-feed cassette 218 might be shifting from the normal position. The CPU 100 may then perform control for outputting, on the display panel 120, a message suggesting that the position of the trailing edge regulation plate 219 in the paper-feed cassette 218 be checked. Alternatively, if Te< the reaching time T and the reaching time T of the previous piece of the recording material P is within the range of Tf to Td, the CPU 100 may make the same determination as above.

Furthermore, variation (Tf to Td) in the reaching time T is generally set while using maximum variations in conveying from the ideal value Tc, which corresponds to a state in which the trailing edge regulation plate 219 is set at the normal position, as margins. Therefore, even if there are differences in variation between image forming apparatuses, margins need not be taken into consideration if the thresholds are determined in accordance with the differences in variation between image forming apparatuses. In this embodiment, by monitoring the reaching time T, a shift in the position of the trailing edge regulation plate 219 in the paper-feed cassette 218 from the normal position can be accurately determined because the differences in variation in conveying between image forming apparatuses are taken into consideration. In addition, in an example in which the determination accuracy further improves, the threshold Td may be updated on the basis of the reaching times T measured in a period in which a number of pieces of the recording material P are conveyed.

As described above, according to this embodiment, appropriate measures can be taken even if a conveying failure occurs due to a backward shift in the position of the recording material P in the paper-feed cassette 218 in the feeding direction. That is, a message indicating that the trailing edge regulation plate 219 might be shifting from the normal position is displayed in order to prompt the user to check the position of the trailing edge regulation plate 219. As a result, the user can check the position of the trailing edge regulation plate 219 that might have been incorrectly set and accordingly set the recording material P to the normal position in the paper-feed cassette 218.

Here, for example, if the user is notified of only occurrence of a conveying failure, the user might remove the recording material P that has caused the conveying failure, but it is unlikely that the user checks the position of the recording material P in the paper-feed cassette 218. In this case, a conveying failure might occur again. According to this embodiment, however, occurrence of such a situation can be suppressed.

Second Embodiment

In the first embodiment, if the reaching time T of a piece of the recording material P is longer than Td but shorter than or equal to Te, a message is output. In a second embodiment, however, if the reaching time T becomes longer than Td but shorter than or equal to Te a plurality of times, a message is output.

Control characteristic to the second embodiment will be described hereinafter with reference to FIGS. 6 and 7. The configuration of the image forming apparatus 200, the method for measuring the reaching time T, and the like according to this embodiment are the same as those according to the first embodiment, and accordingly the same reference numerals are given and detailed description thereof is omitted.

Figure 6:
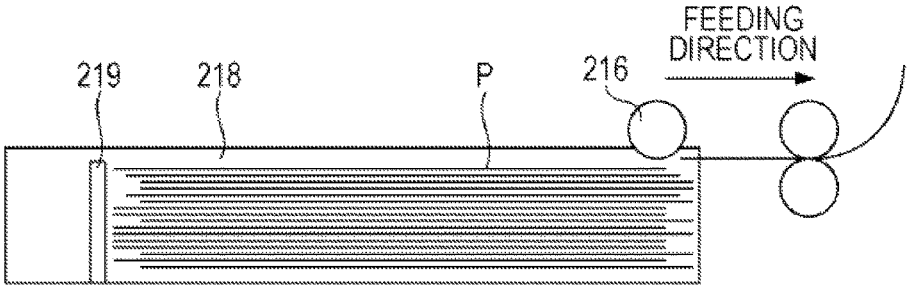
FIG. 6 is a diagram illustrating the state of a recording material in a paper-feed cassette according to a second embodiment.

FIG. 6 is a diagram illustrating a state in which the recording material P is set in the paper-feed cassette 218. If the recording material P is set while the trailing edge regulation plate 219 is shifting from the normal position in the direction opposite to the feeding direction, the trailing edge of the recording material P might not match the position of the trailing edge regulation plate 219.

If the positions of pieces of the stored recording material P vary like this, the reaching time T of the recording material P varies between the pieces of the recording material P when the pieces of the recording material P are sequentially conveyed. This embodiment enables appropriate processing even in such a case.

Figure 7:
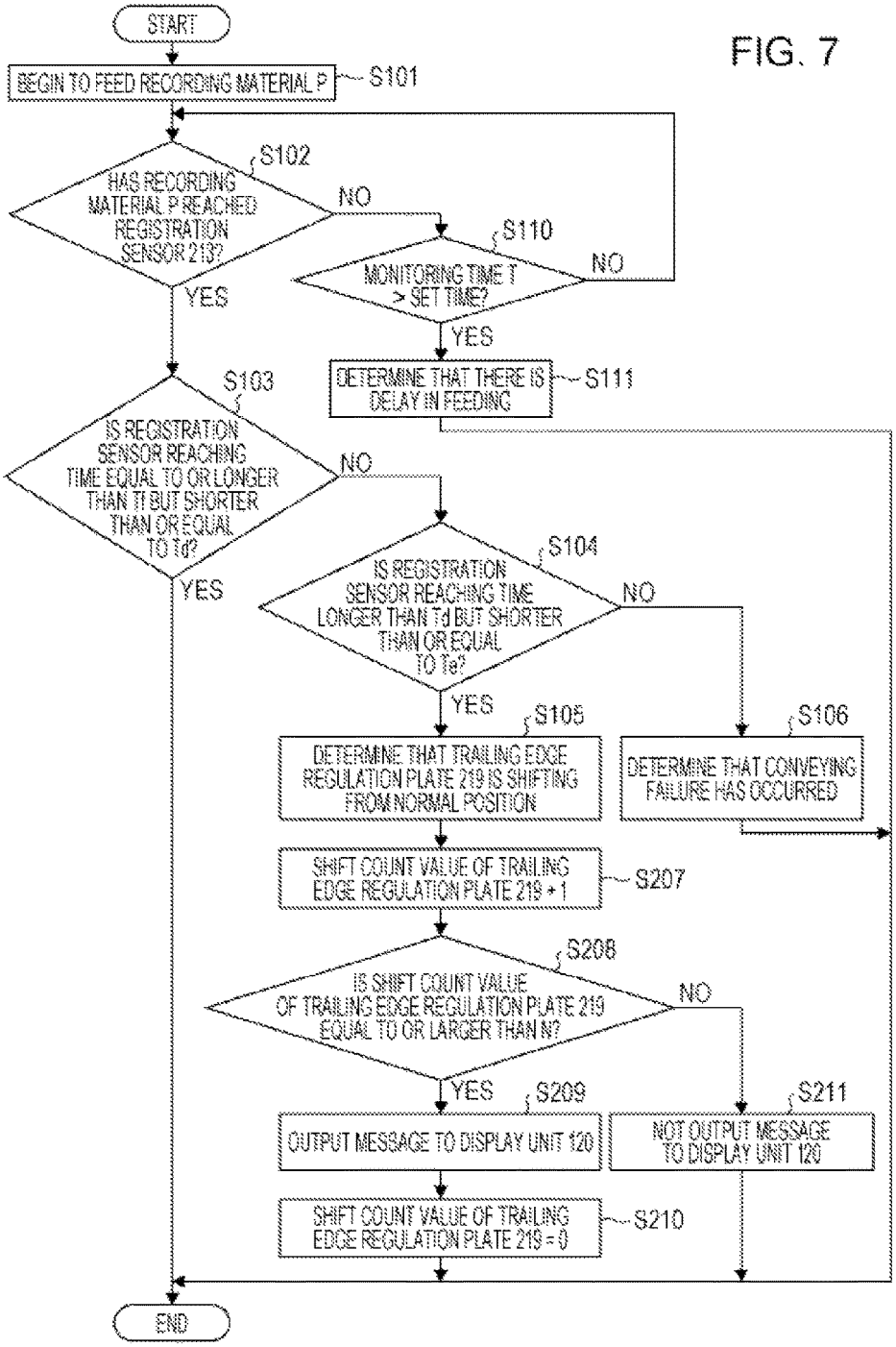
FIG. 7 is a flowchart according to the second embodiment.

FIG. 7 is a flowchart illustrating a control operation performed by the CPU 100 according to this embodiment. Description of the same steps as those according to the first embodiment, such as S101, S102, and S103 illustrated in FIG. 7, is omitted, and only characteristic control will be described.

After determining that the trailing edge regulation plate 219 is shifting from the normal position (S105), the CPU 100 increments a counter that counts the number of times that the recording material P is shifting from the normal position (S207). The counter (not illustrated) is provided inside the CPU 100.

Next, the CPU 100 compares a count value (accumulation value) of the number of times that the recording material P is shifting from the normal position with a reference number N stored in the memory 101 of the controller 110 in advance (S208). If the count value (accumulation value) is smaller than the reference number N, a message suggesting that the position of the trailing edge regulation plate 219 be checked is not output on the display panel 120 (S211). On the other hand, if the count value is equal to or larger than the reference number N, the message suggesting that the position of the trailing edge regulation plate 219 be checked is output on the display panel 120 (S209). The count value of the counter is then initialized (S210).

Here, the reference number N can be set, for example, in accordance with the maximum number of pieces of the recording material P that can be stored in the paper-feed cassette 218 or the number of pieces of the recording material P actually stored in the paper-feed cassette 218. In this embodiment, the maximum number of pieces of the recording material P that can be stored in the paper-feed cassette 218 is 100, and the reference number N is 10.

In this embodiment, the reference number N is 10% of the maximum number of pieces of the recording material P that can be stored in the paper-feed cassette 218.

This reference number N is an example, and may be set on the basis of the maximum number of pieces of the recording material P that can be stored in the paper-feed cassette 218 and by experimentally examining how much the stored recording material P shifts when the trailing edge regulation plate 219 shifts from the normal position.

As described above, according to this embodiment, appropriate measures can be taken while taking productivity into consideration even if a conveying failure occurs due to a backward shift in the position of the recording material P in the paper-feed cassette 218 in the feeding direction. That is, a message indicating that the trailing edge regulation plate 219 might be shifting from the normal position is displayed in order to prompt the user to check the position of the trailing edge regulation plate 219. As a result, the user can check the position of the trailing edge regulation plate 219 that might have been incorrectly set and accordingly set the recording material P to the normal position in the paper-feed cassette 218.

Third Embodiment

In addition, control that takes into consideration deterioration of the paper-feed roller 216, the conveying rollers 215, and the like and resultant delays in the feeding timing and the conveying timing can be performed.

For example, the number of images formed (also referred to as the "number of images printed") since the beginning of use of the image forming apparatus 200 is counted and stored in the memory 101. By removing the effects of deterioration of the paper-feed roller 216, the conveying rollers 215, and the like in accordance with the number of images formed, which is stored in the memory 101, it becomes possible to determine more accurately whether the trailing edge regulation plate 219 is shifting.

Figures 8, 9:
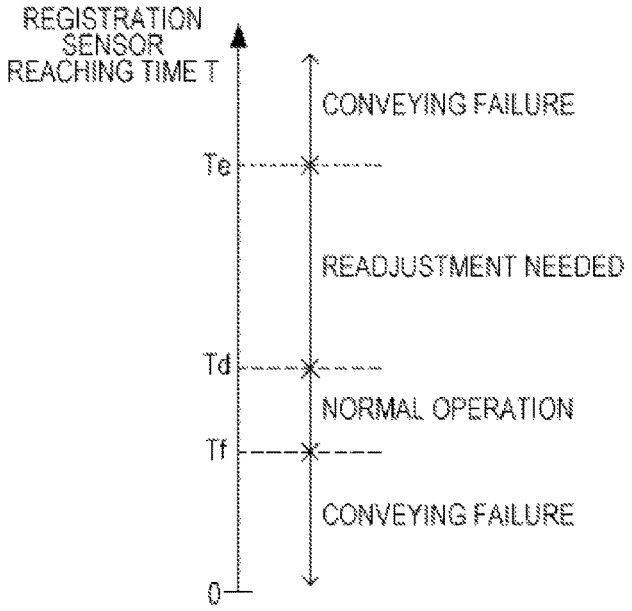
FIG. 8 is a diagram illustrating a relationship between the number of images formed and correction time in a third embodiment.
FIG. 9 is a diagram illustrating a relationship between reaching time of a recording material and thresholds in a fourth embodiment.

For example, FIG. 8 illustrates a table for subtracting correction time alpha from the reaching time T each time 5,000 images have been formed, that is, different correction times alpha are subtracted between, for example, when the number of images formed is 0 to 5,000 and when the number of images formed is 5,001 to 10,000. As illustrated in FIG. 8, for example, if the number of images formed is 8,000, correction time 2 alpha, which corresponds to 5,001 to 10,000 images, is selected. Therefore, the reaching time T−2 alpha is calculated as the reaching time.

Although the correction time alpha changes every 5,000 images in this embodiment, the correction time alpha may change differently in accordance with how a feeding roller and conveying rollers used in each apparatus deteriorate (differences in variation between apparatuses).

As described above, according to this embodiment, the reaching time can be calculated while reducing the effect of deterioration of the rollers. Therefore, by applying the correction of the reaching time in this embodiment to the first or second embodiment, the determination of a shift of the trailing edge regulation plate 219 can be made more accurately.

Fourth Embodiment

A fourth embodiment will be described. In this embodiment, after a cassette, which is a storage unit storing a recording material, is removed and attached (opened and closed), the time until the recording material reaches a position along a conveying path after the recording material is fed is measured. Whether the position of a regulation plate in the cassette needs to be checked is then determined on the basis of the measured time.

Configuration of Image Forming Apparatus 1

Figure 10:
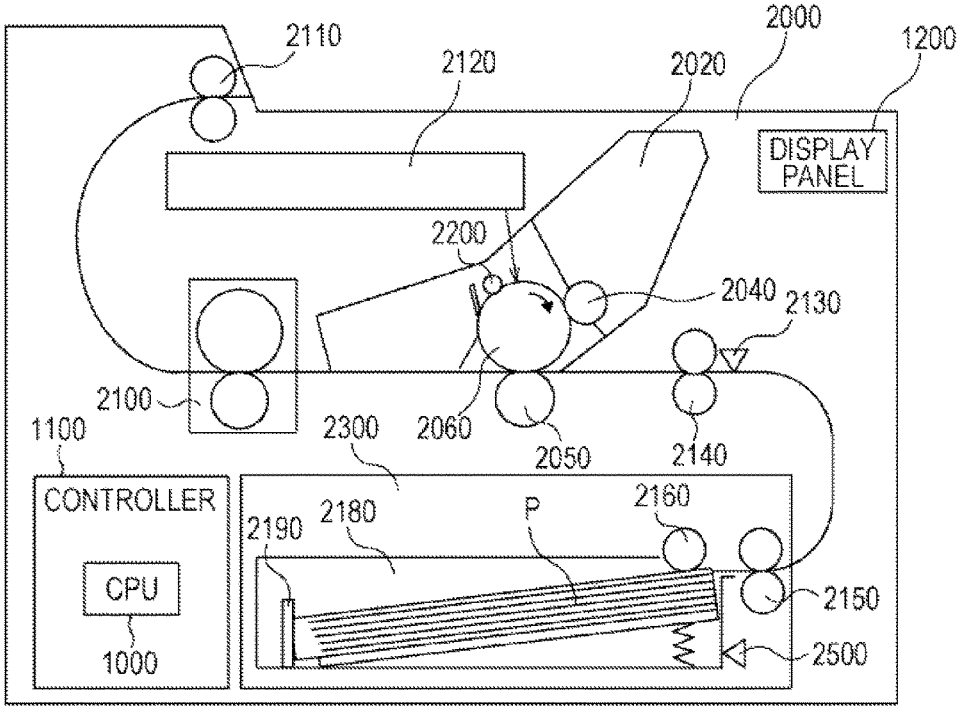
FIG. 10 is a diagram illustrating the configuration of an image forming apparatus.

FIG. 10 illustrates an example of the configuration of an image forming apparatus 2000. The operation of the image forming apparatus 2000 is controlled by a controller 1100. A CPU 1000, which is an arithmetic processing unit, is mounted on the controller 1100. The recording material P is stored in a cassette 2180 and fed by a paper-feed roller 2160, which is a conveying unit, piece by piece at timings. The fed recording material P is then conveyed by conveying rollers 2150 and 2140 to a photosensitive drum 2060. The conveying units (the conveying rollers 2140 and 2150) are driven by a conveying motor 2330 and a solenoid 2340, which will be described later. A feeding unit 2300, which is a feeding device, includes the cassette 2180, which is the unit storing the recording material P, a trailing edge regulation plate 2190, which is a regulation member, that controls the recording material P in the cassette 2180, the paper-feed roller 2160, and the conveying rollers 2150. A sensor 2130, which is a first detection member, provided along the conveying path of the recording material P detects the recording material P. The image forming apparatus 2000 also includes an open/close sensor 2500, which is a detection member, that detects opening and closing of the cassette 2180 in order to detect opening and closing of the cassette 2180. The CPU 1000 measures time until the leading edge of the recording material P reaches the sensor 2130 after the paper-feed roller 2160 begins to feed the recording material P. A display panel 1200 displays (issues) information indicating the state of the image forming apparatus 2000, such as printing, standby, or occurrence of a conveying failure. Such information is displayed to alert a user who is using the image forming apparatus 2000.

The image forming apparatus 2000 according to this embodiment is an electrophotographic printer. The photosensitive drum 2060 rotates in a direction of an arrow illustrated in FIG. 10. Charging voltage is applied to a charging roller 2200, and developing voltage is applied to a developing roller 2040 at a timing. The charging roller 2200 uniformly charges a surface of the photosensitive drum 2060. A scanner unit 2120, which is an exposure unit, outputs laser light at a timing. The laser light output from the scanner unit 2120 is radiated onto the photosensitive drum 2060 to form an electrostatic latent image on the photosensitive drum 2060. A toner container 2020 is filled with toner. The developing roller 2040 rotates to supply toner in the toner container 2020 to the photosensitive drum 2060, and the formed electrostatic latent image is developed as a toner image. A transfer roller 2050 is in contact with the photosensitive drum 2060 to form a nip. The conveyed recording material P is pinched by the nip and further conveyed. Transfer voltage having a polarity opposite to that of toner is applied to the transfer roller 2050 to transfer the toner image on the photosensitive drum 2060 to the recording material P. The recording material P to which the toner image has been transferred is further conveyed to a fixing unit 2100. The fixing unit 2100 heats and pressurizes the recording material P to fix the toner image onto the recording material P. The recording material P onto which the toner image is fixed is discharged from the image forming apparatus 2000 by conveying rollers 2110.

Operation 1

Figure 12:
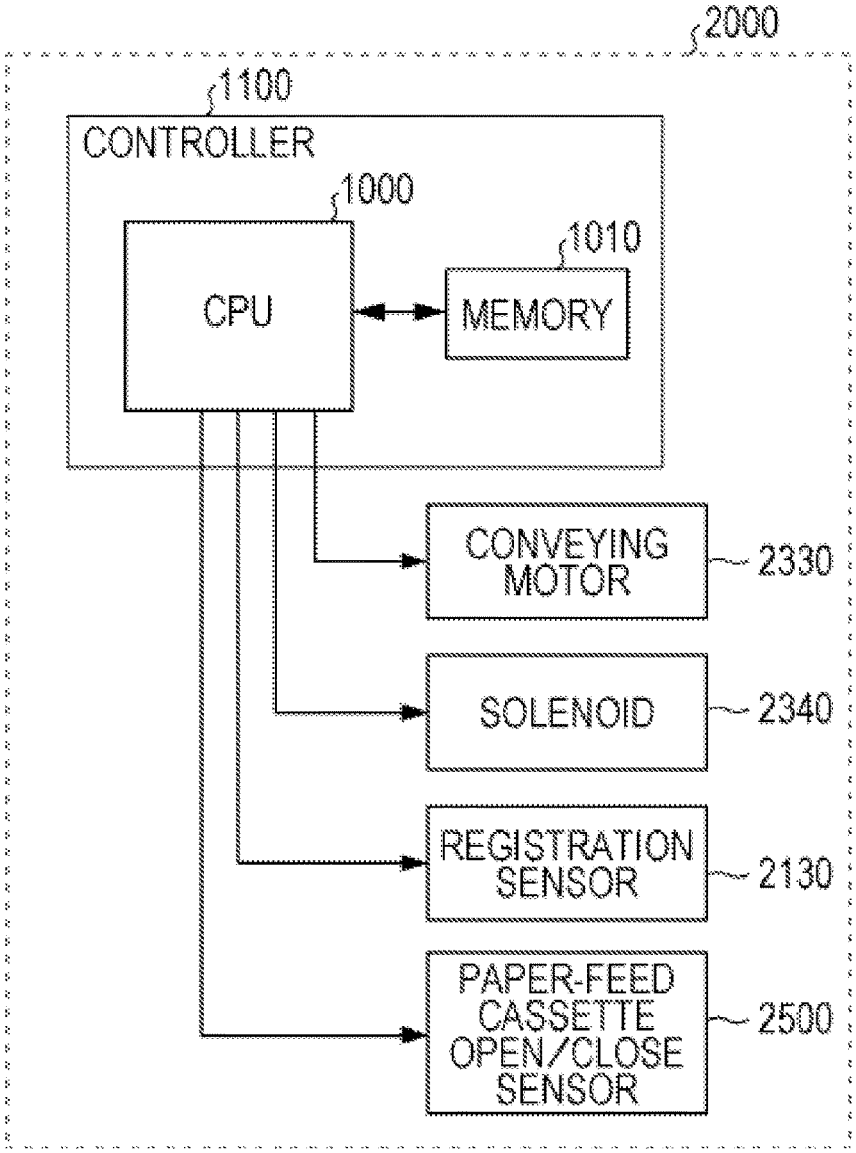
FIG. 12 is a block diagram illustrating an example of the configuration of a control unit.

An operation characteristic to this embodiment will be described. FIG. 12 is a block diagram illustrating an example of the configuration a control unit, which controls the conveying of the recording material P and is realized by the CPU 1000, in the image forming apparatus 2000. First, the CPU 1000 drives the conveying motor 2330 to rotate the conveying rollers 2150. Thereafter, in accordance with an instruction to begin to form an image, the CPU 1000 drives the solenoid 234 at a predetermined timing to rotate the paper-feed roller 2160 one revolution. A top one of a plurality of pieces of the recording material P stored in the paper-feed cassette 2180 and pushed upward comes into contact with the paper-feed roller 2160. Since the paper-feed roller 2160 rotates one revolution in this state, the recording material P is fed piece by piece and conveyed to the conveying rollers 2150. The recording material P is further conveyed by the rotating conveying rollers 2150 to the sensor 2130. When the leading edge of the recording material P reaches the sensor 2130, the sensor 2130 detects the leading edge of the recording material P. A detection signal from the sensor 2130 is input to the CPU 1000. The CPU 1000 measures time T (hereinafter referred to as "reaching time T") until the sensor 213 detects the leading edge of the recording material P after the solenoid 2340 is turned on, and stores the reaching time T in a memory 1010, which is a storage unit. In this embodiment, the memory 1010 is a non-volatile memory. The memory 1010 includes a region storing a reaching time Tv(k) (k=1, 2, . . . n) for each piece of the conveyed recording material P and a region storing reaching times Tz(p) (p=1, 2, . . . , m) after the cassette 2180 is opened and closed (n and m are natural numbers). The reaching times T before the cassette 2180 is opened and closed are stored as the reaching times Tv(k), and the reaching times T after the cassette 2180 is opened and closed are stored as the reaching times Tz(p). Reaching times T in conveying operations later than an m-th conveying operation after the cassette 2180 is opened and closed are again stored as Tv(k).

Next, a method for updating the stored reaching times Tv(k) will be described. In an initial stage of the operation of the image forming apparatus 2000, reaching times Tv(1) to Tv(n) in first to n-th conveying operations are stored. In an (n+1)th conveying operation after the reaching times Tv(1) to Tv(n) are stored, the reaching time Tv(1) measured n operations before is cleared, and the stored reaching time Tv(2) is updated to Tv(1). By updating the reaching time, Tv(k) becomes Tv(k+1), and reaching time Tv(n+1) in the (n+1)th conveying operation is stored as Tv(n) to update Tv(k). Thus, the storage unit of the CPU 1000 always stores n reaching times Tv(k) including a latest reaching time T. Each time a plurality of pieces of the recording material P have been conveyed, the CPU 1000 calculates an average of the n reaching times Tv(k) using the following Expression (1).

[Math. 1]

$$Tv(\text{ave}) = \left(\frac{1}{n}\sum_{k=1}^{n} Tv(k)\right) \tag{1}$$

Thresholds set on the basis of a calculated Tv(ave) are stored in the storage unit of the CPU 1000. A method for setting the thresholds will be described in detail later. Even if not all the n reaching times Tv(1) to Tv(n) are stored, the average Tv(ave) of the stored reaching times Tv(k) may be calculated, and thresholds set on the basis of Tv(ave) may be stored in the storage unit of the CPU 1000. The value of n may be set as necessary. In this embodiment, n=5.

Next, a method for storing the reaching times Tz(p) after the cassette 2180 is opened and closed will be described. After detecting opening and closing of the cassette 2180 on the basis of a signal from the open/close sensor 2500, the CPU 1000 clears the reaching times Tz(p) measured after the cassette 2180 is opened and closed stored in the storage unit thereof. The CPU 1000 then stores m reaching times Tz(p) newly measured after the cassette 2180 is opened and closed. At the end of an m-th conveying operation after the cassette 2180 is opened and closed, the CPU 1000 compares the thresholds set on the basis of Tv(ave) and an average of the m reaching times Tz(p) newly measured after the cassette 2180 is opened and closed. Tz(p) is calculated using the following Expression (2). In this embodiment, m=5. Alternatively, n and m may each be 1, and a single value, not an average, may be used.

[Math. 2]

$$Tz(\text{ave}) = \left(\frac{1}{m}\sum_{p=1}^{m} Tz(p)\right) \tag{2}$$

The CPU 1000 compares a calculated Tz(ave) with the thresholds. Whether the recording material P is being normally conveyed, a conveying failure is occurring, or the trailing edge regulation plate 2190 needs to be readjusted is determined on the basis of a result of the comparison. The determination method will be described in detail later.

In the m-th conveying operation after the cassette 2180 is opened and closed. Tv(n+1)=Tz(m). In the conveying operations later than the m-th conveying operation after the cassette 2180 is opened and closed, the reaching times Tz(p) are no longer stored, and the reaching times Tv(k) begin to be updated again.

Even if the image forming apparatus 2000 is turned off, a state before the image forming apparatus 2000 is turned off is stored and held. More specifically, the number of conveying operations after the cassette 2180 is opened and closed and the n reaching times Tv(k), the reaching times Tz(p) as many as the number of conveying operations, and the thresholds stored in the storage unit of the CPU 1000 are held.

Next, the determination method used by the CPU 1000 will be described. The storage unit of the CPU 1000 stores the lower limit threshold Tf and the upper limit threshold Td for determining whether the recording material P is being normally conveyed. The thresholds Tf and Td are values obtained by adding margins to the average Tv(ave) of the n reaching times Tv(k). The thresholds Tf and Td may be based on the average Tv(ave), or may be based on a value obtained by correcting the average Tv(ave) in consideration of the operation state of the image forming apparatus 2000, the type of recording material P, a surrounding environment, or the like. Alternatively, the thresholds Tf and Td may be based on Tv(1), which is a single value obtained immediately before the paper-feed cassette 218 is opened and closed.

Figure 17:
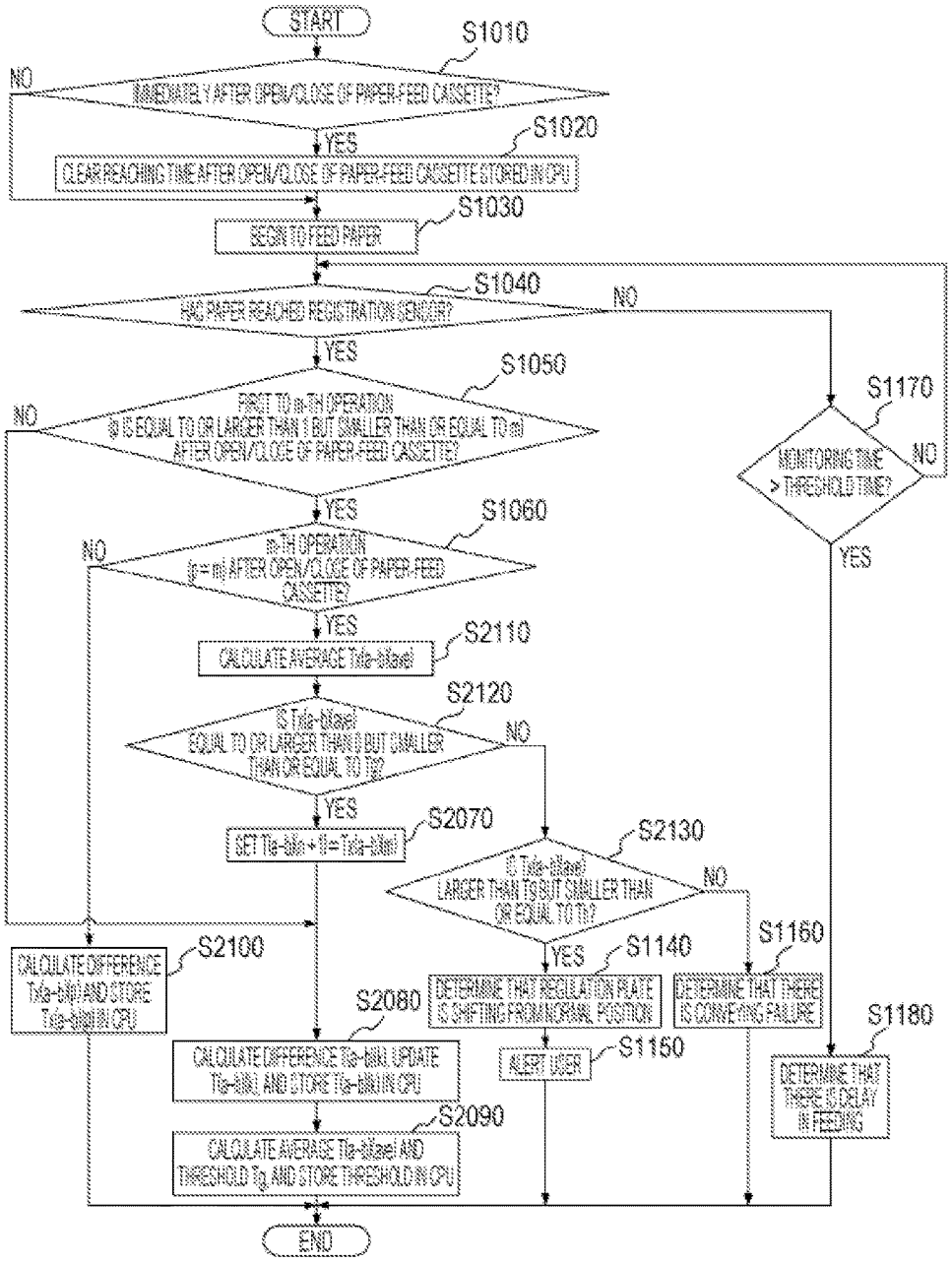
FIG. 17 is a flowchart illustrating an operation performed by a control unit according to the fifth embodiment.

The CPU 1000 determines whether the conveying state of the recording material P is within a range of the normal operation on the basis of a comparison between the reaching time Tz(ave) of the recording material P conveyed after the cassette 2180 is opened and closed and the above-described thresholds Tf and Td illustrated in FIG. 9. More specifically, if the reaching time Tz(ave) is equal to or longer than Tf but shorter than or equal to Td is satisfied as a result of the comparison with the thresholds Tf and Td, that is, if the average of the reaching times is equal to or larger than one of the thresholds (Tf) and smaller than or equal to the other threshold (Td), the CPU 1000 determines that the recording material P is being normally conveyed. Furthermore, the storage unit of the CPU 1000 also stores the threshold Te for determining whether a conveying failure has occurred. The threshold Te is set at least in consideration of the operation state of the image forming apparatus 2000, the type of recording material P, the size of the recording material P, the conveying speed, or the like. Furthermore, the threshold Te is set such that an image can be formed even if the diameters of the paper-feed roller 2160 and conveying rollers 2150 have decreased due to wear or the recording material P slips on the rollers. As illustrated in FIG. 17, the CPU 1000 determines whether the conveying state of the recording material P is within the range of the normal operation on the basis of a comparison between the reaching time Tz(ave) of the recording material P conveyed after the cassette 2180 is opened and closed and the above-described thresholds Tf and Te. More specifically, if the reaching time Tz(ave) falls short of Tf (Tz(ave)<Tf) or exceeds Te (Te<Tz(ave)) as a result of the comparison with the set thresholds Tf and Te, the CPU 1000 determines that it is difficult to appropriately perform a conveying operation or form an image and that a conveying failure has occurred.

Figure 11A:
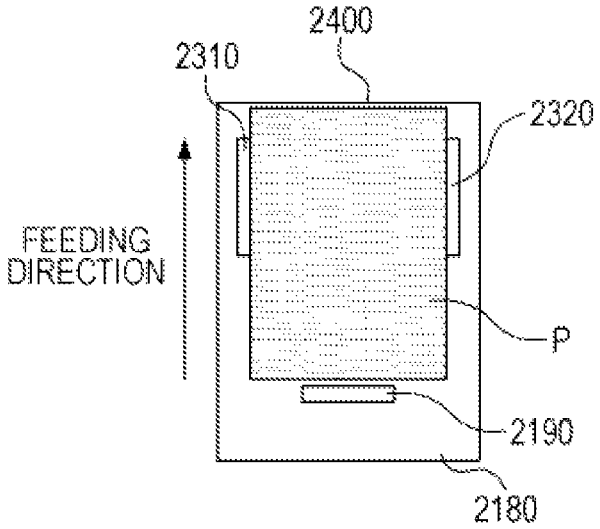
FIG. 11A is a diagram illustrating the position of a recording material in a cassette according to the fourth embodiment.
Figure 11B:
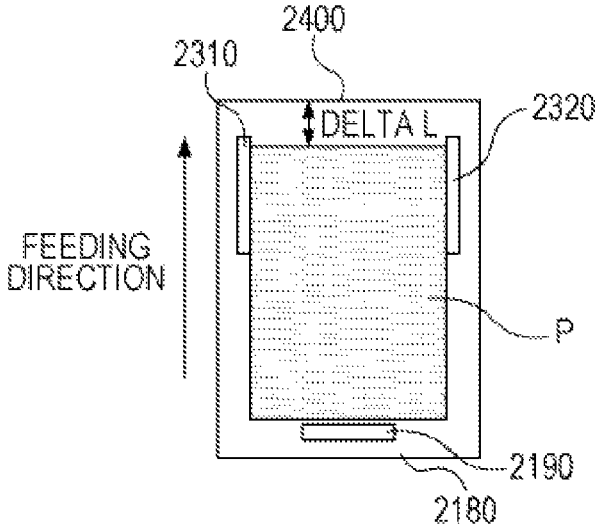
FIG. 11B is a diagram illustrating the position of the recording material in the cassette according to the fourth embodiment.

FIGS. 11A and 11B illustrate states in which the cassette 2180 stores the recording material P. Here, as illustrated in FIG. 11A, it is assumed that, before the thresholds Tf and Td are set, the recording material P is set at a normal position in the paper-feed cassette 2180. The normal position means that the leading edge of the recording material P substantially matches a leading edge regulation plate 2400 of the cassette 2180 in the feeding direction. The trailing edge regulation plate 2190 for the recording material P controls the trailing edge of the recording material P in the feeding direction of the recording material P. Side edge regulation plates 2310 and 2320 control edges of the recording material P in the direction perpendicular to the feeding direction of the recording material P and can move in the direction perpendicular to the feeding direction in accordance with the size of the recording material P stored in the cassette 2180.

On the other hand, as illustrated in FIG. 11B, the position of the trailing edge regulation plate 2190 for the recording material P might move backward from the normal position in the feeding direction, and accordingly the recording material P might be set at a position farther in the feeding direction than the normal position. The trailing edge regulation plate 2190 is a member capable of moving in the feeding direction in accordance with the size of the recording material P in the feeding direction. Therefore, if the user who is setting the recording material P does not reset the trailing edge regulation plate 2190 located farther in the feeding direction back to the normal position, the state illustrated in FIG. 11B appears. If the recording material P set at a position farther in the feeding direction than the normal position is conveyed, a conveying distance, which is a distance between the leading edge of the recording material P and the registration sensor 2130, becomes longer by delta L illustrated in FIG. 11B, and accordingly the reaching time T also becomes longer. Depending on delta L, the reaching time Tz(ave) might exceed Td. In this case, if the reaching time Tz(ave) is shorter than or equal to Te, an image can be formed, but since the recording material P is not set at the normal position in the cassette 2180, a feeding failure or a conveying failure might occur.

Thus, in the conveying when the recording material P is set at a position farther than the normal position, the CPU 1000 performs the following control in order to determine whether the trailing edge regulation plate 2190 needs to be readjusted. More specifically, if the reaching time Tz(ave) of the recording material P conveyed after the cassette 2180 is opened and closed longer than Td but shorter than or equal to Te, the CPU 1000 determines that the trailing edge regulation plate 2190 for the recording material P needs to be readjusted.

As described above, a change in the storage state of the recording material P in the cassette 2180 after the cassette 2180 is opened and closed is detected on the basis of a result of a comparison between the reaching time Tz(ave) of the recording material P conveyed after the cassette 2180 is opened and closed and the thresholds Tf, Td, and Te. Thereafter, whether the trailing edge regulation plate 2190 needs to be readjusted is determined, which is characteristic to this embodiment.

Control Performed by CPU 1

Figure 13:
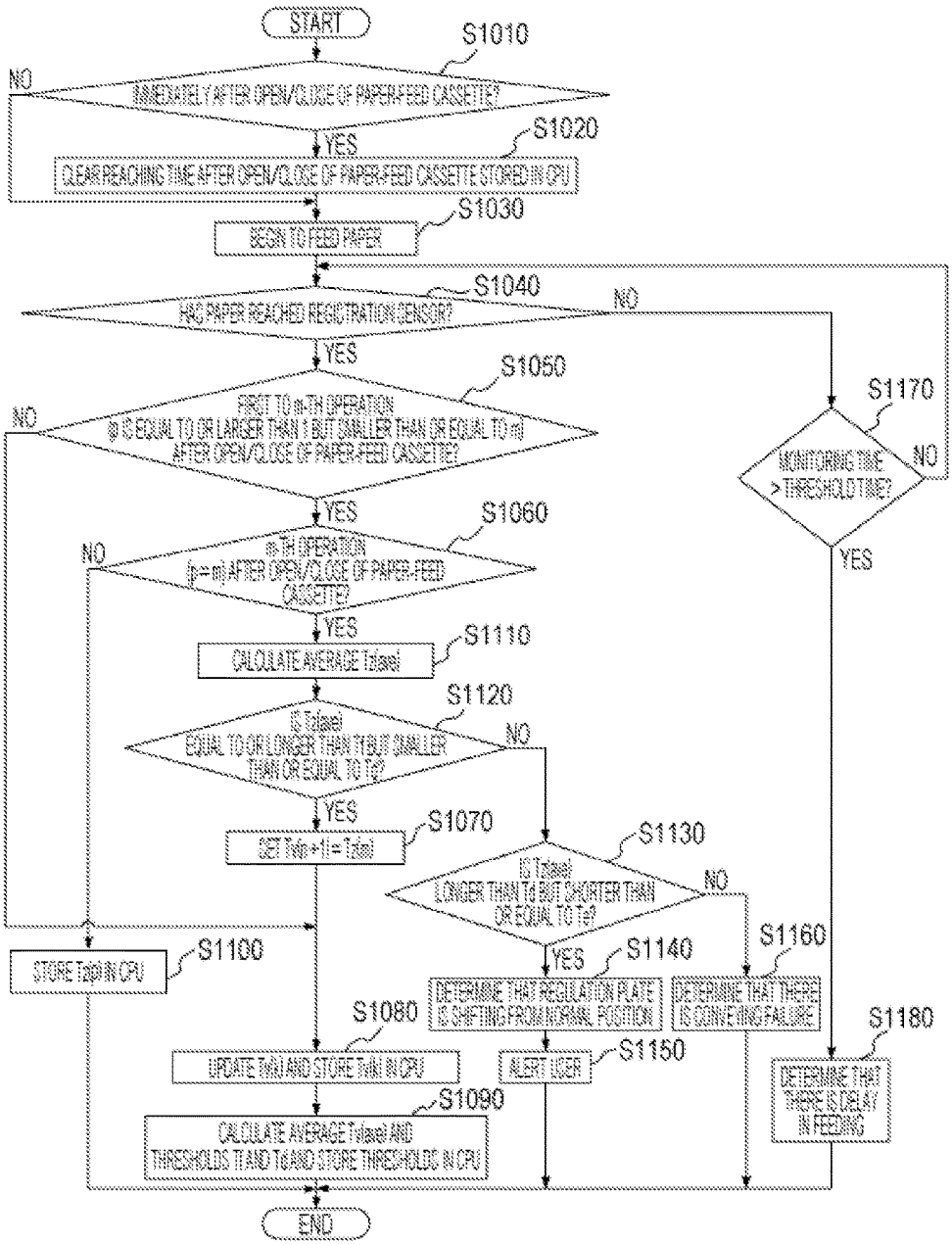
FIG. 13 is a flowchart illustrating an operation performed by the control unit according to the fourth embodiment.

Next, the conveying operation performed by the CPU 1000 according to this embodiment will be described with reference to a flowchart of FIG. 13. It is assumed that before the reaching time T is measured, the CPU 1000 identifies the type of recording material P and the size of the recording material P. The CPU 1000, which controls the conveying of the recording material P, also identifies the conveying speed and the conveying state of the recording material P. The CPU 1000 performs the following control using a program stored in a ROM, which is not illustrated, thereof.

The CPU 1000 determines whether the current operation is an operation for conveying the recording material P immediately after the cassette 2180 is opened and closed (S1010) and, if so, clears the reaching times Tz(p) after the cassette 2180 is opened and closed stored in the memory 1010 (S1020). On the other hand, if the current operation is not an operation for conveying the recording material P immediately after the cassette 2180 is opened and closed, the CPU 1000 dose not clear the reaching times Tz(p). When issuing an instruction to feed the recording material P, the CPU 1000 begins to measure the reaching time T (S1030). The CPU 1000 then monitors whether the reaching time (monitoring time) is longer than the threshold time (S1170). The CPU 1000 continues the monitoring until the recording material P reaches the sensor 2130 (S1040) and, if the recording material P does not reach the sensor 2130 within the threshold time, determines that there is a delay in conveying (S1180) and ends the operation.

After the recording material P reaches the sensor 2130, the CPU 1000 determines whether the current operation is one of the first to m-th conveying operations (p is equal to or larger than 1 but smaller than or equal to m) after the cassette

2180 is opened and closed or one of the conveying operations later than the m-th conveying operation after the cassette 2180 is opened and closed (S1050). If the current operation is one of the conveying operations later than the m-th conveying operation after the cassette 2180 is opened and closed, as described above, the CPU 1000 updates and stores the reaching times Tv(k) in the memory 1010 so that the latest n reaching times Tv(k) are stored (S1080). Thereafter, the CPU 1000 calculates the average Tv(ave) from the latest n reaching times Tv(k) and the thresholds Tf and Td set on the basis of the average Tv(ave) and stores Tv(ave), Tf, and Td in the memory 1010 (S1090). The CPU 1000 then ends the operation.

On the other hand, if the current operation is one of the first to m-th conveying operations after the cassette 2180 is opened and closed (S1050), the CPU 1000 determines whether the current operation is the m-th conveying operation (p=m) after the cassette 2180 is opened and closed (S1060). If p=m is not satisfied (if p<m), the CPU 1000 stores the reaching times Tz(p) after the cassette 2180 is opened and closed (S1100). If p=m, the CPU 1000 calculates the average Tz(ave) from the reaching times Tz(p) (p=1, 2, . . . , m−1) after the cassette 2180 is opened and closed stored therein and the newly measured m-th reaching time Tz(m) (S1110). The CPU 1000 then compares the average Tz(ave) with the thresholds Tf and Td stored in the memory 1010 (S1120). If the reaching time Tz(ave) after the cassette 2180 is opened and closed is equal to or longer than Tf but shorter than or equal to Td, the CPU 1000 determines that the conveying operation is normal. The CPU 1000 then performs processing of Tv(n+1)=Tz(m) (S1070) and the above-described processing in S1080 to S1090. Thereafter, the CPU 1000 ends the operation.

If the reaching time Tz(ave) is not longer than Tf nor shorter than or equal to Td in S1120, the CPU 1000 determines whether the reaching time Tz(ave) is longer than Td but shorter than or equal to Te (S1130). If the reaching time Tz(ave) is equal or longer than Td but shorter than or equal to Te, the CPU 1000 determines that the conveying time of the recording material P is allowable, but the trailing edge regulation plate 2190 for the recording material P in the cassette 2180 might be shifting from the normal position (S1140). After ending the printing operation (the operation for forming an image), the CPU 1000 alerts the user by outputting, through a user interface such as the display panel 1200, information indicating that the position of the trailing edge regulation plate 2190 for the recording material P in the cassette 2180 needs to be checked (S1150). On the other hand, if the reaching time Tz(ave) after the cassette 2180 is opened and closed is not longer than Td nor shorter than or equal to Te, that is, if Tz(ave)<Tf or if Te<Tz(ave), the CPU 1000 determines that there is a conveying failure (S1160) and ends the operation.

Even if a recording material P of a different size is stored after the cassette 2180 is opened and closed, the sensor reaching time T does not change. Therefore, the same operation as above may be performed.

When the reaching time T is compared with the thresholds, the determination may be made while including the thresholds, or the determination may be made without including the thresholds. That is, inequality signs or inequality signs including the equality sign may be arbitrarily used in the determination expressions as necessary.

In the above-described method for storing the reaching times in the memory 1010, the reaching times Tv(n) are stored before the cassette 2180 is opened and closed, the reaching times Tz(m) are stored until the m-th conveying operation after the cassette 2180 is opened and closed, and the reaching times Tv(n) are stored again after the m-th conveying operation. The storage method, however, is not limited to this, and, for example, the following method may be used: (1) a method in which the reaching time T is stored once each before and after the cassette 2180 is opened and closed; (2) a method in which the reaching times Tv(n) are stored only before the cassette 2180 is opened and closed; and (3) a method in which the reaching times Tz(m) continue to be updated even after the m-th conveying operation and, after the cassette 2180 is opened and closed, the reaching times Tz(m) are used as data before the cassette 2180 is opened and closed and the reaching times Tv(n) are newly stored as data after the cassette 2180 is opened and closed.

As described above, according to this embodiment, the reaching time Tz(ave) after the cassette 2180 is opened and closed is compared with the thresholds immediately after the cassette 2180 is opened and closed, when a conveying failure is likely to occur. As a result, the state of the recording material P in the cassette 2180 after the cassette 2180 is opened and closed can be determined. Therefore, even if the position of the recording material P in the cassette 2180 is shifting backward in the feeding direction, occurrence of a conveying failure can be avoided.

Fifth Embodiment

The same components of an image forming apparatus 2000 according to a fifth embodiment as those according to the fourth embodiment are given the same reference numerals, and accordingly description thereof is omitted.

Overview 1

In this embodiment, an average Tx(a−b)(ave) of reaching time differences Tx(a−b)(p) between sensors 2130*a* and 2130*b*, which are second detection units, is used after the cassette 2180 is opened and closed. More specifically, if an average T(a−b)(ave) of reaching time differences T(a−b)(k) is outside a range of thresholds set on the basis of the average T(a−b)(ave), it is possible to alert the user that the positions of the regulation members in the cassette 2180 need to be checked.

Configuration of Image Forming Apparatus 2

Figure 15:
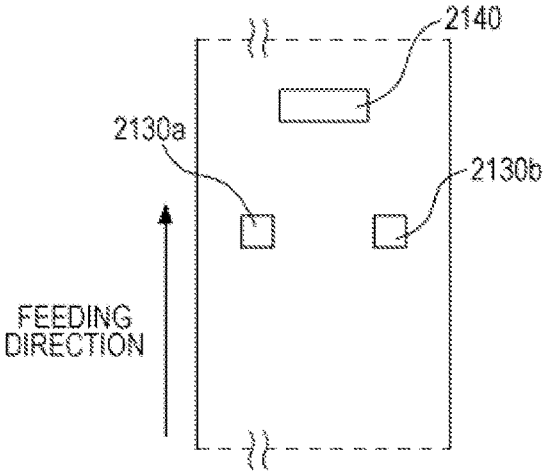
FIG. 15 is a diagram illustrating the configuration of part of an image forming apparatus according to the fifth and sixth embodiments.

FIG. 15 is a diagram illustrating a conveying path around the conveying rollers 2140 and the registration sensors 2130*a* and 2130*b* viewed from above the image forming apparatus 2000. The sensors 2130*a* and 2130*b* provided perpendicular to a conveying direction upstream of the conveying rollers 2140 detect the recording material P and whether the recording material P passes obliquely. The CPU 1000 measures time until the recording material P reaches each of the sensors 2130*a* and 2130*b*, which are the second detection units, after the paper-feed roller 2160 begins to feed the recording material P.

Operation 2

The operation is the same as that in the fourth embodiment until the recording material P reaches the sensors 2130*a* and 2130*b* after the beginning of the feeding operation. Thereafter, when the recording material P reaches the sensors 2130*a* and 2130*b*, the sensors 2130*a* and 2130*b* detect the leading edge of the recording material P. As a result, the CPU 1000 measures reaching time Ta at the sensor 2130*a* and reaching time Tb at the sensor 2130*b*. The CPU 1000 then calculates an absolute value |Ta−Tb| (hereinafter referred to as the "reaching time difference T(a−b)") of a difference between the reaching time Ta and the reaching time Tb and stores the reaching time difference T(a−b) in the memory 1010. The reaching time difference T(a−b) indicates the oblique state of the conveyed recording material P. As in the fourth embodiment, the memory 1010 includes a region that stores a reaching time difference T(a−b)(k) each time the recording material P has been conveyed and a region that stores reaching time differences Tx(a−b)(p) after the cassette 2180 is opened and closed. The reaching time differences T(a−b) before the cassette 2180 is opened and closed are stored as the reaching time differences T(a−b)(k), and the reaching time differences T(a−b) after the cassette 2180 is opened and closed are stored as the reaching time differences Tx(a−b)(p). The reaching time differences T(a−b) in the conveying operations later than the m-th conveying operation after the cassette 2180 is opened and closed are stored again as T(a−b)(k). Each time a plurality of pieces of the recording material P have been conveyed, the CPU 1000 calculates the average T(a−b)(ave) of n reaching time differences T(a−b)(k) using the following Expression (3).

[Math. 3]

$$T(a-b)(\text{ave}) = \left(\frac{1}{n}\sum_{k=1}^{n} T(a-b)(k)\right) \tag{3}$$

The CPU 1000 then stores the thresholds set on the basis of the calculated T(a−b)(ave) in the memory 1010. A method for setting the thresholds will be described in detail later. It is possible that not all the n reaching time differences T(a−b)(1) to T(a−b)(n) are stored. In this case, the average T(a−b)(ave) of the stored T(a−b)(k) is calculated, and the thresholds set on the basis of T(a−b)(ave) may be stored in the memory 1010.

If opening and closing of the cassette 2180 is detected, the CPU 1000 clears the reaching time differences Tx(a−b)(p), which are stored in the memory 1010, detected after the cassette 2180 is previously opened and closed. The CPU 1000 then stores m reaching time differences Tx(a−b)(p) newly detected after the cassette 2180 is opened and closed. At the end of the m-th conveying operation after the cassette 2180 is opened and closed, the CPU 1000 calculates, using the following Expression (4), an average Tx(ave) of the m reaching time differences Tx(a−b)(p) newly detected after the cassette 2180 is opened and closed. The CPU 1000 then compares the calculated Tx(ave) and the thresholds set on the basis of T(a−b)(ave). Alternatively, n and m may each be 1.

[Math. 4]

$$Tx(\text{ave}) = \left(\frac{1}{m}\sum_{k=1}^{m} Tx(a-b)(p)\right) \tag{4}$$

The CPU 1000 then determines on the basis of a result of the comparison whether the recording material P is being normally conveyed, a conveying failure has occurred, or the side edge regulation plates 2310 and 2320 and the trailing edge regulation plate 2190 need to be readjusted. The determination method will be described in detail later.

In the m-th conveying operation after the cassette 2180 is opened and closed, T(a−b)(n+1)=Tx(a−b)(m). In the conveying operations later than the m-th conveying operation after the cassette 2180 is opened and closed, the reaching time differences Tx(a−b)(p) detected after the cassette 2180 is opened and closed are no longer stored, and the reaching time differences T begin to be updated again.

Even if the image forming apparatus 2000 is turned off, a state before the image forming apparatus 2000 is turned off is stored and held. More specifically, the number of conveying operations after the cassette 2180 is opened and closed and the n reaching time differences T(a−b)(k), the m reaching time differences Tx(a−b)(p), and the thresholds stored in the memory 1010 are held and not cleared.

Next, the method for making determinations used by the CPU 1000 will be described. The memory 1010 stores an upper limit threshold Tg for determining whether the recording material P is being normally conveyed. The threshold Tg is a value obtained by adding a margin to the average T(a−b)(ave) of the n reaching time differences T(a−b)(k). The threshold Tg may be the average T(a−b)(ave) itself, or may be based on a value obtained by correcting the average T(a−b)(ave) in consideration of the operation state of the image forming apparatus 2000, the type of recording material P, a surrounding environment, or the like. Alternatively, the threshold Tg may be based on T(a−b)(1), which is a single value obtained immediately before the paper-feed cassette 2180 is opened and closed.

Figure 14:
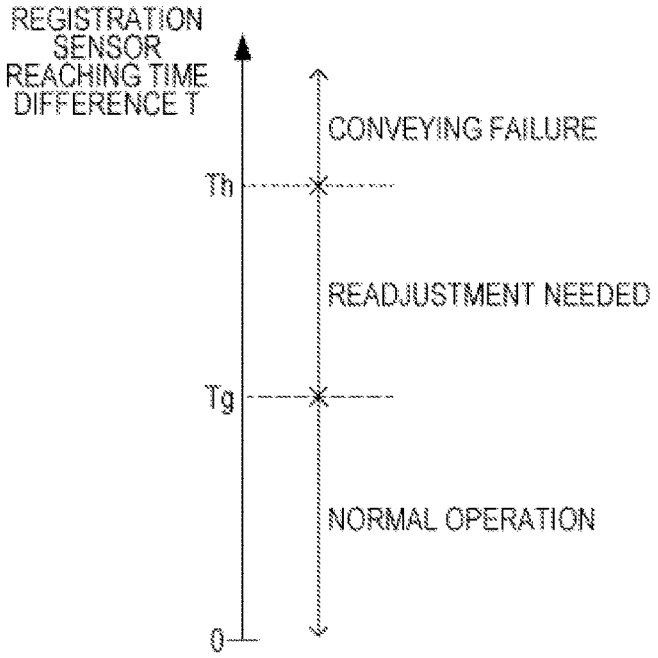
FIG. 14 is a diagram illustrating a relationship between the reaching time of a recording material and thresholds in fifth and sixth embodiments.

The CPU 100 determines whether the conveying state of the recording material P is within the range of the normal operation on the basis of a result of the comparison between the reaching time difference Tx(a−b)(ave) of the recording material P conveyed after the cassette 2180 is opened and closed and the threshold Tg illustrated in FIG. 14. More specifically, if the reaching time difference Tx(a−b)(ave) is equal to or larger than 0 but smaller than or equal to Tg, the CPU 1000 determines that the recording material P is being normally conveyed. Furthermore, the memory 1010 also stores a threshold Th for determining whether a conveying failure has occurred. The threshold Th is set in such a way as to allow an image to be formed at least in consideration of the operation conditions of the image forming apparatus 2000, the type of recording material P, the size of the recording material P, the conveying speed of the recording material P, or the like. The CPU 1000 determines whether the conveying state of the recording material P is within the range of the normal operation on the basis of a result of a comparison between the reaching time difference Tx(a−b)(ave) of the recording material P conveyed after the paper-feed cassette 2180 and the threshold Th illustrated in FIG. 14. More specifically, if the reaching time difference Tx(a−b)(ave) exceeds the set threshold Th (Th<Tx(a−b)(ave)), the CPU 1000 determines that it is difficult to appropriately perform the conveying operation or form an image and that a conveying failure has occurred.

Figure 16A:
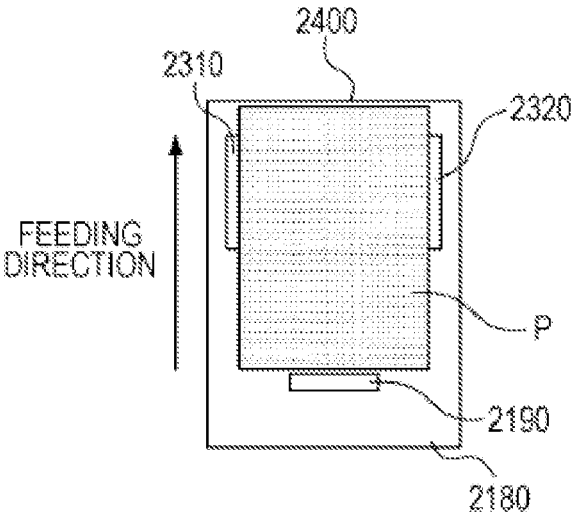
FIG. 16A is a diagram illustrating the state of the recording material in a cassette according to the fifth embodiment.
Figure 16B:
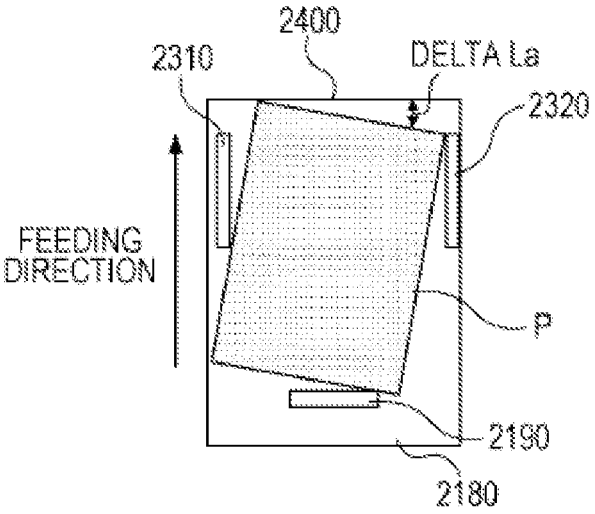
FIG. 16B is a diagram illustrating the state of the recording material in the cassette according to the fifth embodiment.

FIGS. 16A and 16B illustrate states in which the recording material P is stored in the cassette 2180. Here, as illustrated in FIG. 16A, it is assumed that, before the thresholds Tg is set, the recording material P is set at a normal position in the paper-feed cassette 2180. The normal position means that the leading edge of the recording material P in the feeding direction substantially matches the leading edge regulation plate 2400 of the cassette 2180 and side edges of the recording material P substantially match the side edge regulation plates 2310 and 2320. The trailing edge regulation plate 2190 controls the trailing edge of the recording material P in the feeding direction of the recording material P, and the side edge regulation plates 2310 and 2320 control the position of the recording material P in the direction perpendicular to the feeding direction of the recording material P. The regulation plates can move in accordance with the size of the recording material P stored in the cassette 2180.

As illustrated in FIG. 16B, if the positions of the side edge regulation plates 2310 and 2320 and the trailing edge regulation plate 2190 are changed, the recording material P might be set at an angle relative to the normal position. If the recording material P set at an angle relative to the normal position is conveyed, the conveying distance, which is a distance between the leading edge of the recording material P and the sensor 2130*a*, becomes longer by delta La illustrated in FIG. 16B. Accordingly, the reaching time Ta also becomes long. Thus, the reaching time difference Tx(a−b)(ave) between the reaching time Ta at the sensor 2130*a* and the reaching time Tb at the sensor 2130*b* exceeds the threshold Tg. At this time, if the reaching time difference Tx(a−b)(ave) is smaller than or equal to Th, an image can be formed, but since the recording material P in the cassette 2180 is not located at the normal position, a conveying failure might occur. Thus, if the recording material P set at an angle relative to the normal position is conveyed, the CPU 1000 determines, by performing the following control, whether the side edge regulation plates 2310 and 2320 and the trailing edge regulation plate 2190 need to be readjusted. More specifically, if the reaching time difference Tx(a−b)(ave) is larger than Tg but smaller than or equal to Th, the CPU 1000 determines that the side edge regulation plates 2310 and 2320 and the trailing edge regulation plate 2190 need to be readjusted.

As described above, a change after the cassette 2180 is opened and closed is detected on the basis of a result of the comparison between the reaching time difference Tx(a−b)(ave) of the recording material P conveyed after the cassette 2180 is opened and closed and the thresholds Tg and Th. As a result, whether the side edge regulation plates 2310 and 2320 and the trailing edge regulation plate 2190 need to be readjusted is determined, which is characteristic to this embodiment.

Control of Conveying Operation Performed by CPU

Next, the conveying operation performed by the CPU 1000 according to this embodiment will be described with reference to a flowchart of FIG. 17. The same steps as those illustrated in FIG. 13 are given the same reference numerals, and accordingly description thereof is omitted. An overall sequence is the same as that illustrated in the flowchart of FIG. 13, and processing performed in S2070, S2080, S2090, S2100, S2110, S2120, and S2130 is different. In this embodiment, too, the CPU 1000 performs the following control using a program stored in the ROM, which is not illustrated, thereof.

After the recording material P reaches the sensors 2130 (2130*a* and 2130*b*), the CPU 1000 determines whether the current operation is one of the first to m-th (p is equal to or larger than 1 but smaller than or equal to m) operations after the cassette 2180 is opened and closed or one of the conveying operations later than the m-th conveying operation after the cassette 2180 is opened and closed (S1050). If the current operation is one of the conveying operations later than the m-th conveying operation after the cassette 2180 is opened and closed, the CPU 1000 calculates latest n reaching time differences T(a−b)(k) between the reaching times Ta and Tb. The CPU 1000 then updates and stores the reaching time differences T(a−b)(k) in the memory 1010 so that the latest n reaching time differences T(a−b)(k) are stored (S2080). Thereafter, the CPU 1000 calculates the average T(a−b)(ave) from the latest n reaching time differences T(a−b)(k) and the threshold Tg set on the basis of the average T(a−b)(ave). The CPU 1000 stores T(a−b)(ave) and Tg in the memory 1010 (S2090) and ends the operation.

On the other hand, if the current operation is one of the first to m-th conveying operations after the cassette 2180 is opened and closed (S1050), the CPU 1000 determines whether the current operation is the m-th (p=m) conveying operation after the cassette 2180 is opened and closed (S1060). If p=m is not satisfied (if p<m), the CPU 1000 calculates the reaching time differences Tx(a−b)(p) after the cassette 2180 is opened and closed and stores the reaching time differences Tx(a−b)(p) after the cassette 2180 is opened and closed in the memory 1010 (S2100). If p=m, the CPU 1000 calculates the average Tx(a−b)(ave) from the reaching times Tx(a−b)(p) (p=1, 2, . . . , m−1) after the cassette 2180 is opened and closed stored therein and the m-th reaching time difference Tx(a−b)(m) (S2110). The CPU 1000 then compares the average Tx(a−b)(ave) with the threshold Tg stored in the memory 1010 (S2120). If the reaching time difference Tx(a−b)(ave) after the cassette 2180 is opened and closed is equal to or larger than 0 but smaller than or equal to Tg, the CPU 1000 determines that the conveying operation is normal. The CPU 1000 then performs processing of T(a−b)(n+1)=Tx(a−b)(m) (S2070) and the above-described processing in S2080 and S2090. Thereafter, the CPU 1000 ends the operation.

Next, if the reaching time difference Tx(a−b)(ave) after the cassette 2180 is opened and closed is not equal to or larger than 0 nor smaller than or equal to Tg, the CPU 1000 determines whether the reaching time difference Tx(a−b)(ave) is equal to or larger than Tg but smaller than or equal to Th (S2130). The subsequent operation is the same as that illustrated in FIG. 13, and accordingly description thereof is omitted.

When the reaching time T is compared with the thresholds, the determination may be made while including the thresholds, or the determination may be made without including the thresholds. That is, inequality signs or inequality signs including the equality sign may be arbitrarily used in the determination expressions as necessary.

As described above, according to this embodiment, the reaching time difference Tx(a−b)(ave) after the cassette 2180 is opened and closed is compared with the thresholds immediately after the cassette 2180 is opened and closed, when a conveying failure is likely to occur. As a result, the state of the recording material P in the cassette 2180 after the cassette 2180 is opened and closed can be determined. Therefore, even if the recording material P is set at an angle relative to the feeding direction in the cassette 2180, occurrence of a conveying failure can be avoided.

Sixth Embodiment

The same components of an image forming apparatus 2000 according to a sixth embodiment as those according to the fourth or fifth embodiment are given the same reference numerals, and accordingly description thereof is omitted.

Overview 2

In this embodiment, an average Ts(ave) of Ts(p)=(Ta(p)+Tb(p))/2 calculated from reaching times Ta(p) at the sensor 2130*a* and reaching times Tb(p) at the sensor 2130*b*, which are detection units, after the cassette 2180 is opened and closed is used. The CPU 1000 determines whether the average Ts(ave) is outside a range of thresholds set on the basis of an average Tr(ave) of reaching times Tr(k). The CPU 1000 also calculates the average Tx(a−b)(ave) of the reaching time differences Tx(a−b)(p) between the sensor 2130*a* and the sensor 2130*b*, which are detection units, after the cassette 2180 is opened and closed. The CPU 1000 then determines whether the average Tx(a−b)(ave) is outside a range of thresholds set on the basis of the calculated average T(a−b)(ave) of the reaching time differences T(a−b)(k). Therefore, it is possible to alert the user that the positions of the side edge regulation plates 2310 and 2320 and the trailing edge regulation plate 2190, which are regulation members, in the cassette 2180 need to be checked.

Configuration of Image Forming Apparatus 3

The configuration of the image forming apparatus 2000 is the same as that according to the fifth embodiment, and accordingly description thereof is omitted.

Operation 3

The operation until the sensors 2130*a* and 2130*b* measure the reaching time Ta and the reaching time Th, respectively, by detecting the leading edge of the recording material P is the same as that performed in the fifth embodiment. Thereafter, the CPU 1000 calculates a central reaching time Tr=(Ta+Tb)/2 (hereinafter referred to as "reaching time Tr") between the reaching time Ta and the reaching time Th and stores the reaching time Tr in the memory 1010. As in the fourth and fifth embodiments, the memory 1010 includes a region that stores a reaching time Tr(k) and a reaching time difference T(a−b)(k) each time the recording material P has been conveyed and a region that stores reaching times Ts(p) and reaching time differences Tx(a−b)(p) after the cassette 2180 is opened and closed. The reaching times T before the cassette 2180 is opened and closed are stored as the reaching times Tr(k), and the reaching time differences T(a−b) before the cassette 2180 is opened and closed are stored as the reaching time differences T(a−b)(k). The reaching times T after the cassette 2180 is opened and closed are stored as the reaching times Ts(p), and the reaching time differences Tx(a−b) after the cassette 2180 is opened and closed are stored as the reaching time differences Tx(a−b)(p). The reaching times T in the conveying operations later than the m-th conveying operation after the cassette 2180 is opened and closed are again stored as Tr(k), and the reaching time differences T(a−b) are again stored as T(a−b)(k).

The CPU 1000 calculates the average Tr(ave) of n reaching times Tr(k) using the following Expression (5) each time the recording material P has been conveyed.

[Math. 5]

$$Tr(\text{ave}) = \left(\frac{1}{n}\sum_{k=1}^{n} Tr(k)\right) \tag{5}$$

The CPU 1000 then calculates the average T(a−b)(ave) of the reaching time differences T(a−b)(k) through the same operation as that performed in the fifth embodiment and stores thresholds set on the basis of Tr(ave) and T(a−b)(ave) in the memory 1010. A method for setting the thresholds will be described in detail later.

Similarly, the reaching times Ts(p)=(Ta(p)+Tb(p))/2 (hereinafter referred to as "reaching times Ts") and the reaching time differences Tx(a−b)(p) after the cassette 2180 is opened and closed are also stored in the memory 1010.

If opening and closing of the cassette 2180 is detected, the CPU 1000 clears the central reaching times Ts(p)=(Ta(p)+Tb(p))/2 (hereinafter referred to as "reaching times Ts") and the reaching time differences Tx(a−b)(p) between the reaching times Ta and the reaching times Tb stored in the memory 1010. Thereafter, m central reaching times Ts(p)=(Ta(p)+Tb(p))/2 and m reaching time differences Tx(a−b)(p) between the reaching times Ta and the reaching times Tb newly measured after the cassette 2180 is opened and closed are stored.

The CPU 1000 sets the thresholds on the basis of Tv(ave) and T(a−b)(ave) at the end of the m-th conveying operation after the cassette 2180 is opened and closed. The CPU 1000 then calculates the average Ts(ave) of the m reaching times Ts(p) newly measured after the cassette 2180 is opened and closed using the following Expression (6).

[Math. 6]

$$Ts(\text{ave}) = \left(\frac{1}{m}\sum_{p=1}^{m} Ts(p)\right) \tag{6}$$

The CPU 1000 compares Ts(ave) and the average Tx(a−b)(ave), which is the value calculated using the Expression (3), of the reaching time differences Tx(a−b)(p). In accordance with a result of the comparison, the CPU 1000 determines whether the recording material P is being normally conveyed, a conveying failure has occurred, or the side edge regulation plates 2310 and 2320 and the trailing edge regulation plate 2190 need to be readjusted. A determination method will be described in detail later.

In the m-th conveying operation after the cassette 2180 is opened and closed, Tr(n+1)=Ts(m) and T(a−b)(n+1)=Tx(a−b)(m). In the conveying operations later than the m-th conveying operation after the cassette 2180 is opened and closed, the reaching times Ts(p) and Tx(a−b)(p) measured after the cassette 2180 is opened and closed are no longer stored, and the reaching times Tr(k) and T(a−b)(k) begin to be updated again.

Next, the determination method used by the CPU 1000 will be described. Although the n reaching times measured before the cassette 2180 is opened and closed are denoted by Tv(n) in the fourth embodiment, k reaching times measured before the cassette 2180 is opened and closed are denoted by Tr(k) and the determination operation is performed in the sixth embodiment.

Although the m reaching times measured after the cassette 2180 is opened and closed are denoted by Tz(m) in the fourth embodiment, p reaching times measured after the cassette 2180 is opened and closed are denoted by Ts(p) and the determination operation is performed in the sixth embodiment. Operations other than above are the same as those performed in the fourth or fifth embodiment, and accordingly description thereof is omitted.

Before and after the cassette 2180 is opened and closed, both a change in the reaching time (Ta+Tb)/2 and a change in the reaching time difference T(a−b) are detected. Whether the side edge regulation plates 2310 and 2320 and the trailing edge regulation plate 2190 need to be readjusted is determined on the basis of these changes, which is characteristic to this embodiment.

Control Performed by CPU 2

Figure 18:
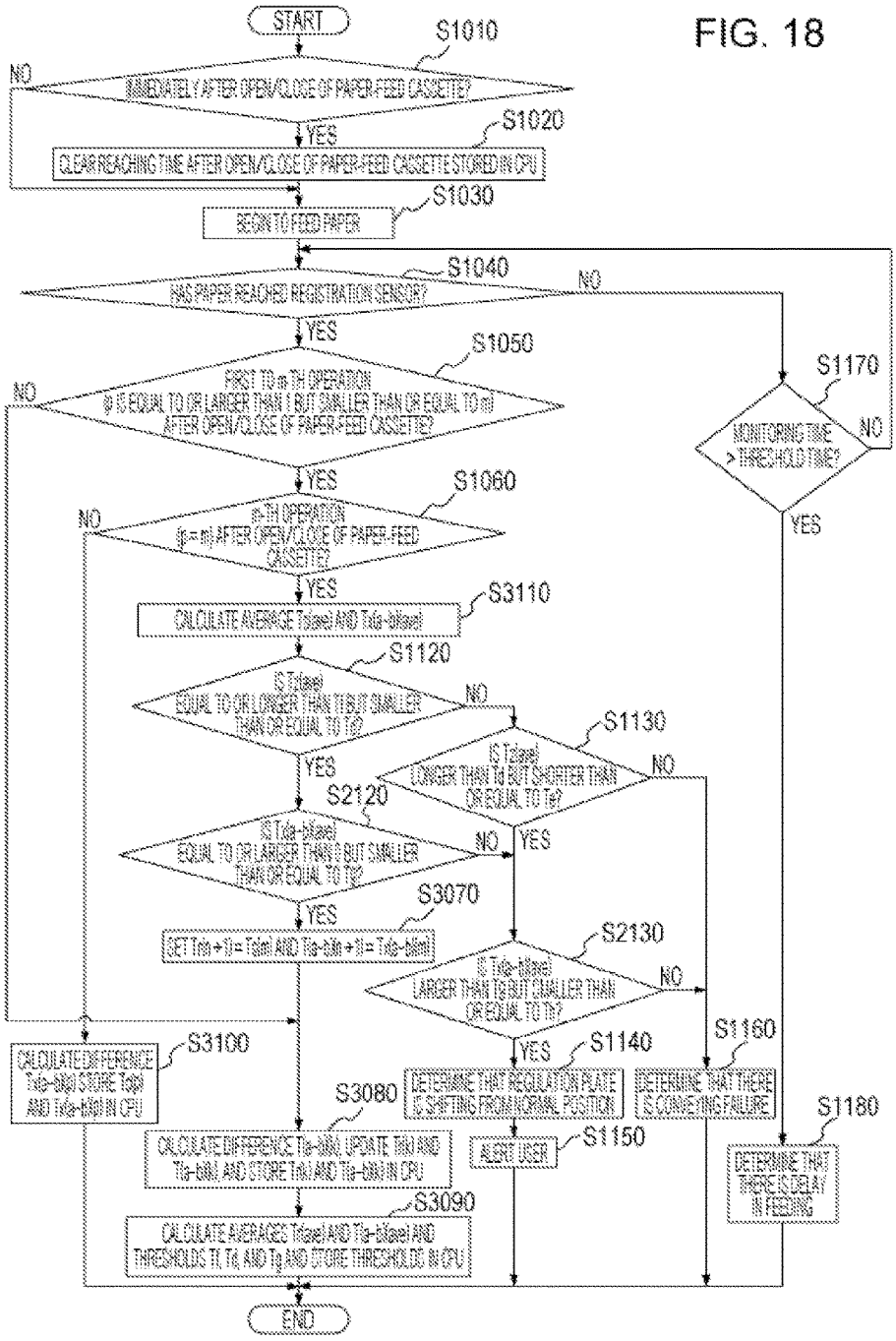
FIG. 18 is a flowchart illustrating an operation performed by a control unit according to the sixth embodiment.

Next, the conveying operation performed by the CPU 1000 according to this embodiment will be described with reference to a flowchart of FIG. 18. The same steps as those illustrated in FIG. 13 or 17 are given the same reference numerals, and accordingly description thereof is omitted. Processing in S3070, S3080, S3090, S3100, and S3110 is different from the flowcharts of FIGS. 13 and 17. The CPU 1000 performs the following control using a program stored in the ROM, which is not illustrated, thereof.

After the recording material P reaches the sensors 2130 (2130*a* and 2130*b*), the CPU 1000 determines whether the current operation is one of the first to m-th (p is equal to or larger than 1 but smaller than or equal to m) conveying operations after the cassette 2180 is opened and closed or one of the conveying operations later than the m-th conveying operation after the cassette 2180 is opened and closed (S1050). If the current operation is one of the conveying operations later than the m-th conveying operation after the cassette 2180 is opened and closed, the CPU 1000 updates the reaching times Tr(k) stored in the storage unit thereof so that latest n reaching times Tr(k) are stored. Furthermore, the CPU 1000 calculates the reaching time differences T(a−b)(k) between the reaching times Ta and the reaching times Tb and updates and stores the reaching time differences T(a−b)(k) in the memory 1010 so that the latest reaching time differences T(a−b)(k) are stored (S3080). Thereafter, the CPU 1000 calculates the average Tr(k)(ave) from the latest n reaching times Tr(k) and reaching time differences T(a−b)(k) and the thresholds Tf, Td, and Tg set on the basis of the averages Tr(k)(ave) and T(a−b)(ave). The CPU 1000 then stores Tr(k)(ave), T(a−b)(ave), Tf, Td, and Tg in the memory 1010 (S3090) and ends the operation.

On the other hand, if the current operation is one of the first to m-th conveying operations after the cassette 2180 is opened and closed (S1050), the CPU 1000 determines whether the current operation is the m-th (p=m) conveying operation after the cassette 2180 is opened and closed (S1060). If p=m is not satisfied (if p<m), the CPU 1000 calculates the reaching time differences Tx(a−b)(p) after the cassette 2180 is opened and closed and stores the reaching times Ts(p) and the reaching time differences Tx(a−b)(p) after the cassette 2180 is opened and closed in the memory 1010 (S3100). If p=m, the CPU 1000 calculates the average Ts(ave) from the reaching times Ts(p) (p=1, 2, . . . , m−1) after the cassette 2180 is opened and closed stored therein and the newly detected m-th reaching time Ts(m). Furthermore, the CPU 1000 calculates the average Tx(a−b)(ave) from the reaching time differences Tx(a−b)(p) (p=1, 2, . . . , m−1) after the cassette 2180 is opened and closed stored in the memory 1010 and the newly detected m-th reaching time difference Tx(a−b)(m) (S3110). The CPU 1000 then performs the processing in S1120, S2120, S1130, and S2130 as in the fourth and fifth embodiment in order to determine whether the recording material P is being normally conveyed, the side edge regulation plates 2310 and 2320 and the trailing edge regulation plate 2190 might be shifting from the normal positions, or there is a conveying failure.

When the reaching time T is compared with the thresholds, the determination may be made while including the thresholds, or the determination may be made without including the thresholds. That is, inequality signs or inequality signs including the equality sign may be arbitrarily used in the determination expressions as necessary.

As described above, according to this embodiment, the reaching times Ts after the cassette 2180 is opened and closed and the thresholds, and the reaching time differences Tx(a−b) and the thresholds, are compared with each other immediately after the cassette 2180 is opened and closed, when a conveying failure is likely to occur. As a result, the state of the recording material P in the cassette 2180 after the cassette 2180 is opened and closed can be determined. Therefore, even if the recording material P is set at an angle in the cassette 2180 relative to the feeding direction, occurrence of a conveying failure can be avoided.

Although the reaching times immediately after the cassette is opened and closed are used in the fourth to sixth embodiments, the reaching times used are not limited to these. For example, the same effect can be produced using reaching times before and after the image forming apparatus is turned on and off. After the image forming apparatus is turned off, it is difficult for the CPU 1000 to detect opening and closing of the cassette. Therefore, if the storage state of the recording material P in the cassette changes after the image forming apparatus is turned off, it is effective to use reaching times before and after the image forming apparatus is turned on and off.

In addition, although an image forming apparatus is assumed in the above embodiments, the present invention can be applied to an optional feeding apparatus including a plurality of cassettes storing recording materials. The optional feeding apparatus is an apparatus that can be mounted as an optional apparatus of the image forming apparatus described in each of the above embodiments.

OTHER EMBODIMENTS

Figure 19:
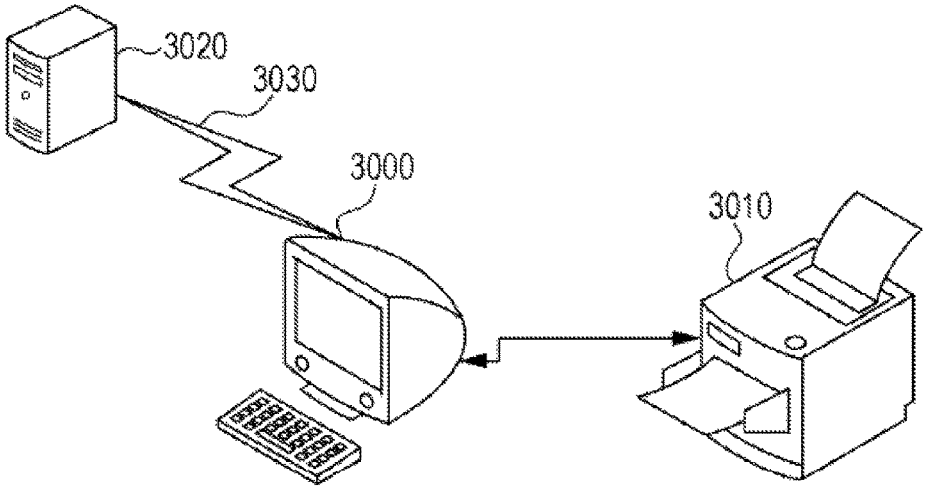
FIG. 19 is a diagram illustrating an example of an image forming system.

An image forming system can be configured by combining the image forming apparatus according to one of the first to sixth embodiments, a computer, which is an input/output apparatus, connected to the image forming apparatus, and a server computer connected to the image forming apparatus through a network or the like. For example, by using the computer connected to the image forming apparatus as an input unit and a display unit, a message suggesting that the regulation members be checked can be displayed to notify the user of the condition. FIG. 19 illustrates an example of the image forming system.

FIG. 19 illustrates the configuration of a system in which a computer 3000 is connected to a server 3020 through a network 3030 and an image forming apparatus 3010 is connected to the computer 3000. For example, the image forming apparatuses according to the first to sixth embodiments measure reaching times and transmit results of the measurement to the computer 3000. The computer 3000 transmits information regarding the reaching times to the server 3020. The server 3020 can accumulate and manage information regarding reaching times for each image forming apparatus. For example, on the basis of the transmitted information regarding the reaching times, an image forming apparatus whose regulation members need to be checked can be identified. With respect to an image forming apparatus for which the regulation members need to be frequently checked or for which information for prompting the user to check the regulation members is frequently output, information for prompting the user to check whether the regulation members are abnormal may be output to the computer 3000. As a result, an abnormality in the regulation members of the image forming apparatus can also be monitored.

Thus, by outputting the information for prompting the user to check the regulation members or the information regarding an abnormality in the regulation members for the user through the network 3030, cases in which the user needs to ask a service person to inspect the image forming apparatus can be decreased. In the case of an error that the user can easily remove, such as incorrect setting of the regulation members, the user can immediately solve the problem, which is advantageous.

Such an image forming system may be configured to collect information from another computer or a printer connected to the server 3020 and manage the information. In this case, the system may be configured by a combination of a plurality of computers and a printer, a combination of a plurality of computers and a plurality of printers, or a combination of a computer and a plurality of printers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-248444, filed Nov. 29, 2013, and Japanese Patent Application No. 2014-095837, filed May 7, 2014, which are hereby incorporated by reference herein in their entirety.

REFERENCE SIGNS LIST

100 CPU
213 registration sensor
214 conveying roller
215 conveying roller
216 paper-feed roller
218 paper-feed cassette
219 trailing edge regulation plate
233 conveying motor
234 solenoid

The invention claimed is:

1. An image forming apparatus comprising:

a storage unit configured to store a recording material;

a feeding unit configured to feed the recording material from the storage unit to a conveying path;

a regulation member configured to control a trailing edge of the recording material in a feeding direction in the storage unit;

a detection unit configured to detect time until the recording material reaches a predetermined position along the conveying path after the feeding unit begins to feed the recording material; and a control unit configured to determine a state of the regulation member based on the time detected by the detection unit, wherein, in a case where the time detected by the detection unit is a value between a first threshold and a second threshold, which is larger than the first threshold, the control unit determines that the regulation member is shifting from a position corresponding to a size of the recording material in the feeding direction.

2. The image forming apparatus according to claim 1, wherein the control unit counts a number of times that the detected time falls between the first threshold and the second threshold and, in a case where a count value exceeds a threshold, determines that the regulation member is shifting from the position corresponding to the size of the recording material.

3. The image forming apparatus according to claim 1, wherein, in a case where the control unit determines that the regulation member is shifting from the position corresponding to a size of the recording material, the control unit outputs information indicating that the regulation member is shifting from the position.

4. The image forming apparatus according to claim 3, wherein the regulation member is configured to move to a reference position corresponding to the size of the recording material in the feeding direction, and wherein the information includes information indicating that the regulation member is shifting in a direction opposite to the feeding direction of the recording material.

5. The image forming apparatus according to claim 1, further comprising an operation unit configured to specify a size of the recording material.

6. The image forming apparatus according to claim 1, wherein, in a case where the detected time is a value larger than the second threshold, the control unit determines that a conveying failure has occurred.

7. The image forming apparatus according to claim 1, wherein the first threshold is set in accordance with variation in feeding of a plurality of pieces of the recording material by the feeding unit.

8. The image forming apparatus according to claim 1, wherein the control unit counts a number of pieces of the recording material on which an image is formed and corrects the time detected by the detection unit in accordance with a count value.

9. The image forming apparatus according to claim 8, wherein a value used for correcting the detected time becomes larger as the count value becomes larger.

10. The image forming apparatus according to claim 3, further comprising a display unit configured to display information.

11. An image forming apparatus comprising:

a storage unit configured to store a recording material;

a feeding unit configured to feed the recording material from the storage unit to a conveying path;

a regulation member configured to control a trailing edge of the recording material in a feeding direction in the storage unit;

a detection unit configured to detect opening and closing of the storage unit; and a control unit configured to control, wherein, before the detection unit detects opening and closing of the storage unit, the control unit measures reaching time, which is time until the recording material reaches a position along the conveying path after the feeding unit begins to feed the recording material, as a first reaching time and after the detection unit detects opening and closing of the storage unit, the control unit measures the reaching time as second reaching time and controls to determine a state of the regulation member based on measured first reaching time and second reaching time.

12. The image forming apparatus according to claim 11, wherein the control unit compares, as a comparison, the second reaching time with a threshold based on the first reaching time and determines the state of the regulation member in accordance with a result of the comparison.

13. The image forming apparatus according to claim 12, wherein, based on the result of the comparison, the control unit determines whether the regulation member is shifting from a normal position.

14. The image forming apparatus according to claim 11, further comprising a sensor configured to detect recording material that has reached the position along the conveying path, wherein, after the feeding unit begins to feed the recording material, the control unit measures time until the sensor detects the recording material.

15. The image forming apparatus according to claim 11, wherein, in a case where the reaching time is larger than a first threshold but smaller than a second threshold, which is larger than the first threshold, the control unit determines that the regulation member is not set at a position corresponding to a size of the recording material.

16. The image forming apparatus according to claim 15, wherein, in a case where the reaching time is smaller than or equal to the first threshold, the control unit determines that the recording material has been normally conveyed and, in a case where the reaching time is equal to or larger than the second threshold, the control unit determines that a conveying failure has occurred.

17. The image forming apparatus according to claim 11, further comprising a first sensor and a second sensor configured to detect the recording material in a direction perpendicular to a conveying direction of the recording material, wherein the regulation member is a side edge regulation member configured to control an edge of the recording material in a direction perpendicular to the feeding direction of the recording material, and wherein the control unit controls to measure the first reaching time, which is time until the first sensor detects the recording material after the feeding unit begins to feed the recording material, and the second reaching time, which is time until the second sensor detects the recording material after the feeding unit begins to feed the recording material, and controls to determine whether the side edge regulation member is shifting using the first and second reaching times.

18. The image forming apparatus according to claim 17, wherein the control unit obtains a difference between the first reaching time and the second reaching time, compares the obtained difference with a threshold set based on the difference, and determines whether the side edge regulation member is shifting based on a result of the comparison.

19. The image forming apparatus according to claim 18, wherein, in a case where the difference is smaller than or equal to the threshold, the control unit determines that the recording material has been normally conveyed, and wherein, in a case where the difference is equal to or larger than the threshold, the control unit determines that a conveying failure has occurred.

20. The image forming apparatus according to claim 11, wherein the reaching time further is time obtained by averaging a plurality of reaching times measured by conveying a plurality of pieces of the recording material.

21. The image forming apparatus according to claim 11, further comprising a display unit configured to display information, wherein the control unit outputs, to the display unit, information for prompting a check on a position of the regulation member.

22. An image forming system including an image forming apparatus and an input/output apparatus, the image forming system comprising:

a storage unit configured to store a recording material;

a feeding unit configured to feed the recording material from the storage unit to a conveying path;

a regulation member configured to control a trailing edge of the recording material in a feeding direction in the storage unit, and to move in the feeding direction in the storage unit;

a detection unit configured to detect time until the recording material reaches a position along the conveying path after the feeding unit begins to feed the recording material; and a control unit configured to output information, wherein, in a case where the recording material reaches the position along the conveying path after the feeding unit begins to feed the recording material, the control unit outputs, to the input/output apparatus, information indicating a state of the regulation member based on the time detected by the detection unit.

23. The image forming system according to claim 22, wherein the input/output apparatus includes a computer including a display unit, and wherein the display unit of the computer displays the information.

24. The image forming apparatus according to claim 22, further comprising a server connected to the input/output apparatus, wherein the server includes the control unit.

25. An image forming system including an image forming apparatus and an input/output apparatus, the image forming system comprising:

a storage unit configured to store a recording material;

a feeding unit configured to feed the recording material from the storage unit to a conveying path;

a regulation member configured to control a trailing edge of the recording material in a feeding direction in the storage unit, and to move in the feeding direction in the storage unit;

a detection unit configured to detect time until the recording material reaches a position along the conveying path after the feeding unit begins to feed the recording material; and a control unit configured to control, wherein, before the detection unit detects opening and closing of the storage unit, the control unit measures reaching time, which is time until the recording material reaches a position along the conveying path after the feeding unit begins to feed the recording material, as a first reaching time and after the detection unit detects opening and closing of the storage unit, the control unit measures reaching time as second reaching time and controls to output information indicating a state of the regulation member to the input/output apparatus based on measured first reaching time and second reaching time.

26. The image forming system according to claim 25, wherein the input/output apparatus includes a computer including a display unit, and wherein the display unit of the computer displays the information.

27. The image forming system according to claim 25, further comprising a server connected to the input/output apparatus, wherein the server includes the control unit.

* * * * *